US005239926A

United States Patent [19]

Nubson et al.

[11] Patent Number: 5,239,926

[45] Date of Patent: Aug. 31, 1993

[54] CARD PRINTER APPARATUS AND METHOD

[75] Inventors: Richard C. Nubson, Eden Prairie; David A. Adkins, Robbinsdale; Dale E. Hallstrom, Crystal; Christopher B. Johnson, St. Louis Park; Ronald L. Sattler, Bloomington; David E. Wickstrom, St. Louis Park, all of Minn.

[73] Assignee: DataCard Corporation, Minneapolis, Minn.

[21] Appl. No.: 827,289

[22] Filed: Jan. 29, 1992

[51] Int. Cl.[5] ..... B41J 3/02; B65H 3/20

[52] U.S. Cl. ..... 101/487; 400/120; 400/635; 400/130; 346/76 PH; 198/494; 198/844.1; 12/102; 12/103.5; 271/33; 395/108; 101/425; 101/474

[58] Field of Search ..... 400/120, 622, 629, 635, 400/328, 130; 346/76 PH; 101/27-34, 425, 470, 483, 487; 198/494, 496, 844.1; 15/102, 103.5; 271/33; 395/100, 108

[56] References Cited

U.S. PATENT DOCUMENTS

| | | | |
|---|---|---|---|
| 3,262,697 | 7/1966 | Krinke | 271/33 |
| 3,945,481 | 3/1976 | Lindberg | 400/328 |
| 4,176,601 | 12/1979 | Szarka . | |
| 4,537,125 | 8/1985 | Gaucher | 400/635 |
| 4,541,340 | 9/1985 | Peart et al. | 101/470 |
| 4,591,146 | 5/1986 | Sasso . | |
| 4,650,350 | 3/1987 | Dorner | 400/120 |
| 4,918,778 | 4/1990 | Chupin et al. | 15/102 |
| 4,930,911 | 6/1990 | Sampson et al. | 101/29 |
| 5,007,626 | 4/1991 | Blaimschein . | |
| 5,025,267 | 6/1991 | Schofield et al. . | |
| 5,025,399 | 6/1991 | Wendt et al. . | |
| 5,037,216 | 8/1991 | Nubson et al. . | |
| 5,070,781 | 12/1991 | Lundstrom et al. | 101/32 |
| 5,080,512 | 1/1992 | Schofield et al. . | |
| 5,133,616 | 7/1992 | Oyaide et al. | 400/635 |

FOREIGN PATENT DOCUMENTS

| | | | |
|---|---|---|---|
| 0038176 | 10/1981 | European Pat. Off. | 400/635 |
| 0267673 | 5/1989 | Fed. Rep. of Germany | 75/103.5 |

OTHER PUBLICATIONS

"Document Feed" IBM Technical Disclosure Bulletin, vol. 21, No. 9, Feb. 1979, pp. 3533-3534.

"Document Feeder Exit Control" IBM Technical Discl. Bulletin, vol. 24, No. 1B, Jun. 1981, pp. 824-826.

"Variable Speed Driver" IBM Technical Disclosure Bulletin, vol. 25, No. 7A, Dec. 1982, p. 3282.

*Primary Examiner*—Eugene H. Eickholt

*Attorney, Agent, or Firm*—Merchant Gould Smith Edell Welter & Schmidt

[57] ABSTRACT

A printer apparatus including a print head assembly and a transport belt for transporting a workpiece such as a plastic card through the printer apparatus. The transport belt includes a surface self-adhering to a surface of the plastic card. In a preferred embodiment, the printer apparatus includes a print head which is moved across a surface of the card while printing on the card. The printer apparatus includes a print head controller for interfacing between at least one microprocessor and at least one continuous tone print head, the number of print intensities either fixed or selected by the microprocessor.

39 Claims, 18 Drawing Sheets

CARD PRINTER APPARATUS AND METHOD

FIELD OF THE INVENTION

The present invention relates to a printer apparatus and method including novel features for manipulating movement of a workpiece relative to a printer apparatus which includes a print head, and a print head controller apparatus and method for controlling printing by the printer apparatus. More specifically, it relates to an apparatus for transporting a receptor material, such as a plastic credit card, on a belt system which enables multiple pass printing over the entire exposed face of the receptor material without encumbering the printing process, and includes a print head controller apparatus for interfacing between at least one microprocessor and at least one continuous tone print head.

BACKGROUND OF THE INVENTION

When printing a colored image onto a receptor material such as a plastic credit card, three primary colors are typically used to create the composite color image. This is typically accomplished in three separate printing passes using a print head to print each of the three primary colors successively from a ribbon onto the credit card. A printing pass is commonly accomplished by moving the credit card across a fixed print head. The credit card is typically moved either by the use of a set of rollers acting upon the surface of the card or by carrying the card along a carriage yoke.

There exist several known devices for transporting a workpiece such as a credit card. As above, the card may be urged forward through the use of various rubber roller sets, or less commonly, through the use of hardened pins. The roller sets may be used in conjunction with upper and lower guide rails to maintain card position stability. The carriage yoke is typically provided with leading and trailing fingers for retaining the card, and may be driven via a steel cable and roller set. Other known devices for transporting the card include a tabbed timing belt with a plastic finger for driving the card into and out of the device, and urethane belts situated along the front and back sides of the card which are also used in conjunction with roller sets.

One problem encountered with some of these methods of transporting a card in association with a printing operation is the difficulty in being able to accurately line up the printing of each color on the card during each pass of the card before the print head so that the image has the desired clarity and resolution, particularly when printing tonal color images at the high rates attainable by typical card printers. Another problem is that full card printing is restricted either to a single pass of the print head or that the print head has only partial access to the desired face of the card. In a printer apparatus in which the printing is accomplished using a thermal print head, it is necessary that the full card surface be clear of all obstructions to enable printing on any portion of the card surface; however, it is equally necessary that some form of card holding device be used to retain the card in proper alignment with the print head.

Alternative card holding devices include vacuum technology and mechanical clamping devices. Vacuum technology requires numerous components such as a vacuum pump, control valve, and an expanded system controller board. Vacuum pumps produce an extra heat load and audible noise, and present additional problems in accommodating the components within the physical confines of existing card handling systems. To mechanically retain the card without obstructing the face of the card would require means for holding the card edges, which would cause the card to bow away from the retainer surface. Furthermore, to truly secure the card by these means would necessitate wrapping the mechanical retention means onto the printed side of the card, thereby interfering with the printing process. Additionally, mechanical means would need to be provided for removing the card from the card holding devices.

Thermal print heads such as thin film, thick film, and edge print heads consist of a line of resistive heating elements protected by a wear resistant layer. The resistive elements generate heat when a voltage is applied. Thermal print heads generally consist of one or more $1 \times N$ bit shift registers with an output stage capable of providing the power necessary to energize a resistor, where N is either the maximum width or height of the image in pixels. Data is clocked into the print head one bit at a time. The number of shift registers used depends on the particular thermal print head used.

Digital continuous tone pixels use multi-bit values, which requires that a print head be loaded many times to print a single row of an image. For instance, if six bits are used to store intensity levels for the image, the print head must be loaded $2^6$ or 64 times.

Most applications control the print head directly by a microprocessor. The microprocessor provides both the data stream, clock, and other control signals required by the print head. Because the microprocessor has other duties such as managing print data and controlling other printer functions, the speed of print head operations is usually below its maximum and can exhibit irregularities depending on how busy the microprocessor is. This slow down is even more noticeable with continuous tone printing due to the large amount of data that must be sent to the print head.

Therefore, there is a need to provide a way to increase the print speed of a print head to near its maximum amount.

The present invention solves these and other problems associated with a card transport device and print head controller for use in a printer.

SUMMARY OF THE INVENTION

It is an object of the present invention to provide a printer apparatus and method for use in printing graphic images on a surface of a receptor material such as a plastic credit card, the printer apparatus including a card manipulation apparatus wherein the card is secured upon a card transport system by means which do not obscure any portion of the surface to be printed.

The card securing means provided for in the present invention include a transport belt composed of or coated with a soft elastomer material, such as urethane or natural rubber. The nature of the soft elastomer material used in the transport belt is such that a rigid receptor material such as a standard plastic credit card adheres to the transport belt surface without the use of additional adhesive materials. In the present invention, an unembossed credit card is pressed into the soft elastomer surface of the transport belt to positively secure the card for movement through the print operation. Upon completion of the print operation, the transport belt is drawn around a shaft or pulley, thereby causing differential stretching of the soft elastomer material. The stretching of the soft elastomer causes the card to become disengaged from the surface of the transport belt.

Another object of the present invention is to provide a printer apparatus which includes a card manipulation apparatus utilizing a soft elastomer coated card transport belt, the apparatus including a full card-height roller for firmly pressing a card onto the transport belt, the roller also serving to clean the card by removing loose particles from the surface of the card to be printed. In the present invention, the cleaning system which includes the cleaning roller is also provided with means for cleaning both the roller and the transport belt of loose particles.

One embodiment of the present invention provides for multiple pass printing using a soft elastomer coated card transport belt in which the transport belt and card are restrained from movement during the printing operation opposite a moveable thermal print head. A thermal transfer print ribbon is fed between the card face and the thermal print head. The thermal print head is mounted on a carriage system which is driven in reciprocal linear movement relative to the card. The carriage system includes a converter assembly for converting rotary motion of the drive motor into the linear motion required for movement of the carriage system.

Another embodiment of the present invention provides for multiple pass printing using a soft elastomer coated card transport belt in which the thermal print head is fixed and the individual printing passes are accomplished by linear movement of the transport belt and card relative to the thermal print head.

A further object of the present invention is to provide a printer apparatus which includes a card manipulation apparatus utilizing a soft elastomer coated card transport belt wherein the apparatus may have multiple thermal print heads to allow a single pass of the card when printing tonal color images.

The present invention also provides a print head controller for interfacing between at least one microprocessor and at least one continuous tone print head, the number of print intensities either fixed or selected by the microprocessor. Digital image data is loaded from the microprocessor into a first-in first-out (FIFO) memory, where a controller state machine reads the image data from the FIFO memory and compares each pixel value to a level value generated by the state machine and loads a one-bit value into the print head for a number of iterations equal to the number of print intensities. When the print head is loaded, a control signal is sent to the print head to initiate printing.

These and various other advantages and features of novelty which characterize the present invention are pointed out with particularity in the claims annexed hereto and forming a part hereof. However, for a better understanding of the invention, its advantages and objects attained by its use, attention should be given to the drawings which form a further part hereof and to the accompanying descriptive matter in which there is illustrated and described a preferred embodiment of the invention.

BRIEF DESCRIPTION OF THE DRAWINGS

Referring now to the figures in which like reference numerals represent corresponding parts throughout the several views.

DETAILED DESCRIPTION OF THE PREFERRED EMBODIMENT

In the following detailed description of the preferred embodiment, reference is made to the accompanying drawings which form a part hereof and wherein like numerals refer to like parts throughout, and in which is shown by way of illustration a specific embodiment in which the invention may be practiced. It is to be understood that other embodiments may be utilized without departing from the scope of the present invention.

Commonly assigned U.S. Pat. No. 5,080,512, issued on Jan. 14, 1992 and relating to a color printer apparatus, is hereby incorporated by reference into the present application. Additionally, U.S. Pat. No. 5,037,216, issued on Aug. 6, 1991 and relating to a system and method for producing data bearing cards, is also hereby incorporated by reference.

Figure 1:
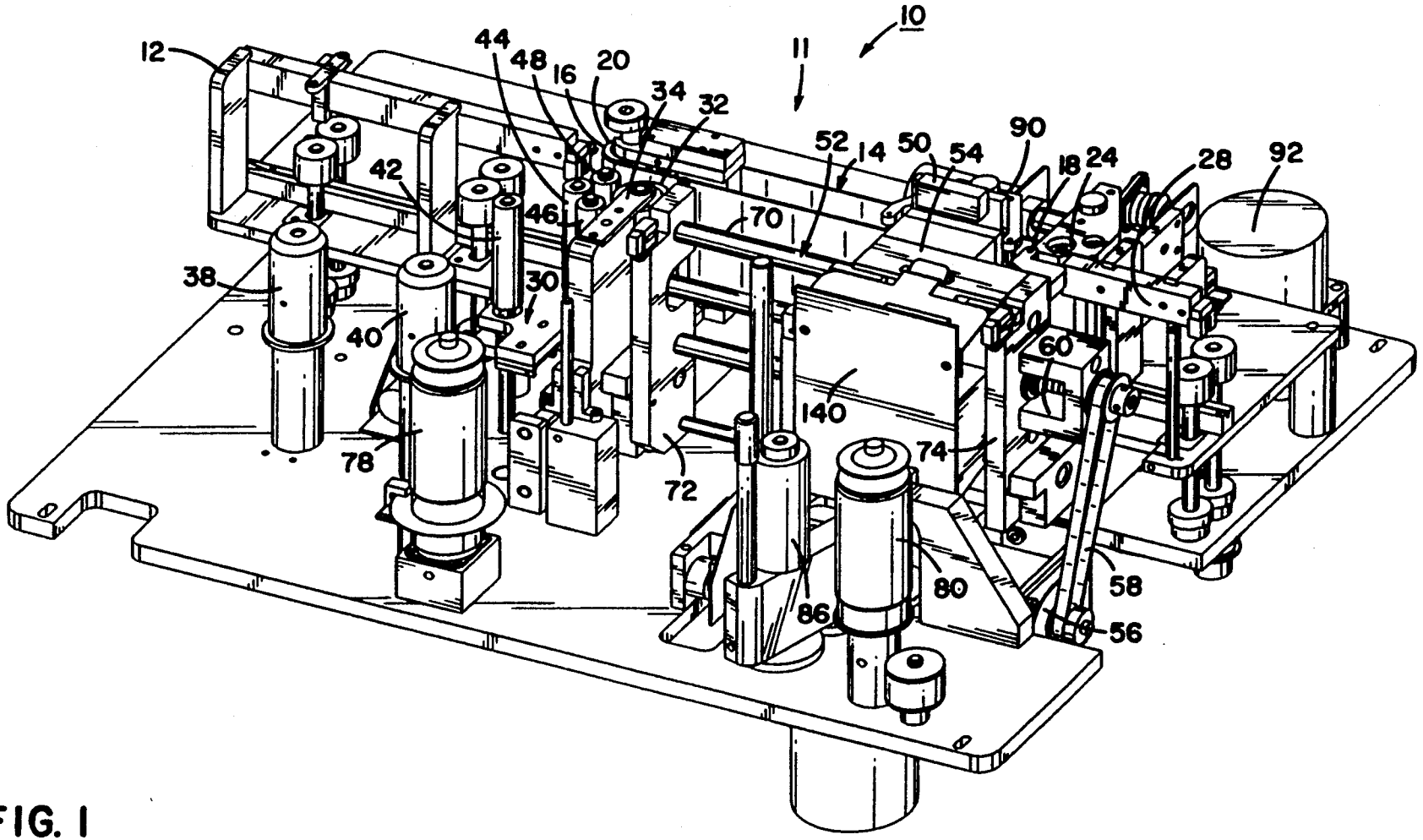
FIG. 1 is a perspective view of one embodiment of a printer apparatus in accordance with the present invention.

Printer Apparatus Including a Card Manipulation Apparatus:

Shown in FIG. 1 is a perspective view of the preferred embodiment of a printer apparatus, generally referred to by the reference numeral 10, including a card manipulation apparatus 11 and print head controller apparatus (not shown, but to be described in detail in the sections to follow) in accordance with the principles of the present invention. The printer apparatus 10 shown may be a component in a modular card processing system which not only has the capability of printing, but in addition can store and feed blank material into the system, emboss, apply magnetic stripes or protective layers, and collect and insert the printed cards into envelopes or the like.

The printer apparatus 10 of the present invention prints color graphic images, including photographs, artwork, or alphanumeric characters, onto a receptor material such as a standard credit card material which is typically CR80 polyvinyl chloride acetate (PVCA) of a thickness ranging from 0.010 inch to 0.030 inch. The printer apparatus 10 prints using a dye diffusion tonal CYM- or CYMB-subtractive color process. CYM and CYMB are taken to represent the primary colors cyan, yellow, and magenta and may also include black. Such a printer apparatus 10 might employ a single thin film thermal print head 50 and a thermal transfer ribbon 76. The transfer ribbon 76 carries a dye which is suspended in a binder on the ribbon 76, the amount of dye being transferred onto the print surface being proportional to the energy produced by the individual dot elements of the thermal print head 50. In other words, as the energy to the dot elements is increased, an increased amount of dye is diffused into the card surface. The transfer ribbon 76 may also carry additional panels for specialized applications, such as transparent infrared dyes which may be read under exposure to ultraviolet lighting.

The dye in the top layer of the printed card may be stabilized and protected from wear and migration into adjacent plastic products, such as card dividers in a wallet or purse. Therefore, in the preferred embodiment, the printing operation described herein is followed by a step of applying a protective layer to the card surface. The protective layer may be applied by the printhead 50 acting upon a clear panel provided in the transfer ribbon 76 for that purpose.

The cards may be manually input into the printer apparatus 10, or, as in the preferred embodiment, fed into the printer apparatus 10 from a card input hopper apparatus which includes a roller assembly which mates with an infeed end of the infeed guide roller assembly 12 of the card manipulation apparatus 11 shown in FIG. 1. As may be seen in FIG. 1, the guide roller assembly 12 terminates at a first end 16 of an endless loop transport belt 14. The belt 14 is coated on a card-receiving side with a soft urethane elastomer. The transport belt 14 travels around two sets of guide pulleys 20, 24. The second end 18 of the transport belt 14 is situated at the lead-in for an outfeed guide roller assembly 28. The outfeed guide roller assembly 28 accepts the printed card from the transport belt 14 and ejects the card out of the card manipulation apparatus 11. In the preferred embodiment, the printed cards are transferred from the card manipulation apparatus 11 of the printer apparatus 10 into an adjacent card processing module, preferably one in which a protective layer can be applied to the newly printed surface of the card.

The printer apparatus 10 of the present invention might include the use of a cationic dye which would not require the application of a protective coating.

As illustrated in FIG. 1, a card cleaning system 30 is situated near the first end of the transport belt 14. The transport belt 14 is cleaned at an operator selectable range. In the preferred embodiment, a portion of the belt 14 is cleaned approximately once for every 20 card printing operations. The card cleaning system 30 is composed of a cleaning roller 32 for removing loose particles and debris from a surface of a card before printing, a cleaning roller carriage 34 provided for reciprocal movement of the cleaning roller 32 perpendicularly away and toward the transport belt 14, cleaning tape 36 (not shown) which is deployed from a cleaning tape supply spindle 38 and is taken up by a cleaning tape takeup spindle 40, cleaning tape drive rollers 42, 44, and idler rollers 46, 48 which guide the cleaning tape 36 into selective contact with the cleaning roller 32 or transport belt 14. The operation of the cleaning system 30 will be discussed in greater detail in the pages to follow.

Referring still to FIG. 1, the transport belt 14 is used to position a blank card relative to a moving thermal print head 50. The thermal print head 50 is shown mounted to a carriage block 54 of a print head carriage assembly 52. The print head carriage block 54 moves in a linear direction parallel to the transport belt 14. The apparatus for making this movement possible includes a drive motor 56, pulley assembly 58, coupling assembly 60 for converting the rotational movement of the drive motor 56 and pulley assembly 58 into constant velocity linear movement, linear bearing supports 70 on which the carriage block 54 slides, and carriage supports 72, 74 at either end of the assembly 52.

The color transfer ribbon 76 is not shown in FIG. 1; however, the ribbon supply spindle 78 and the ribbon takeup spindle 80 are indicated, as well as the various pins which guide the ribbon 76 between the transport belt 14 and the thermal print head 50. The details of the routing of the transfer ribbon 76 are to be discussed later in this description.

Opposite the print head 50 in FIG. 1, a pressure roller assembly 90 is generally shown, including a motor 92 for driving the pressure roller assembly 90 into position during the printing operation. The pressure roller assembly 90 is provided for applying a force during the printing operation against the backside of the card 110 in direct opposition to the thermal print head 50. The force ensures that the printing ribbon dyes are properly transferred into the card surface. The pressure roller assembly 90, and other features, are also to be discussed in greater detail in the sections to follow.

Shown in FIGS. 2*a* through 2*d* are the basic operations when printing a multi-color image on a card according to the preferred embodiment of the invention.

Figure 2A:
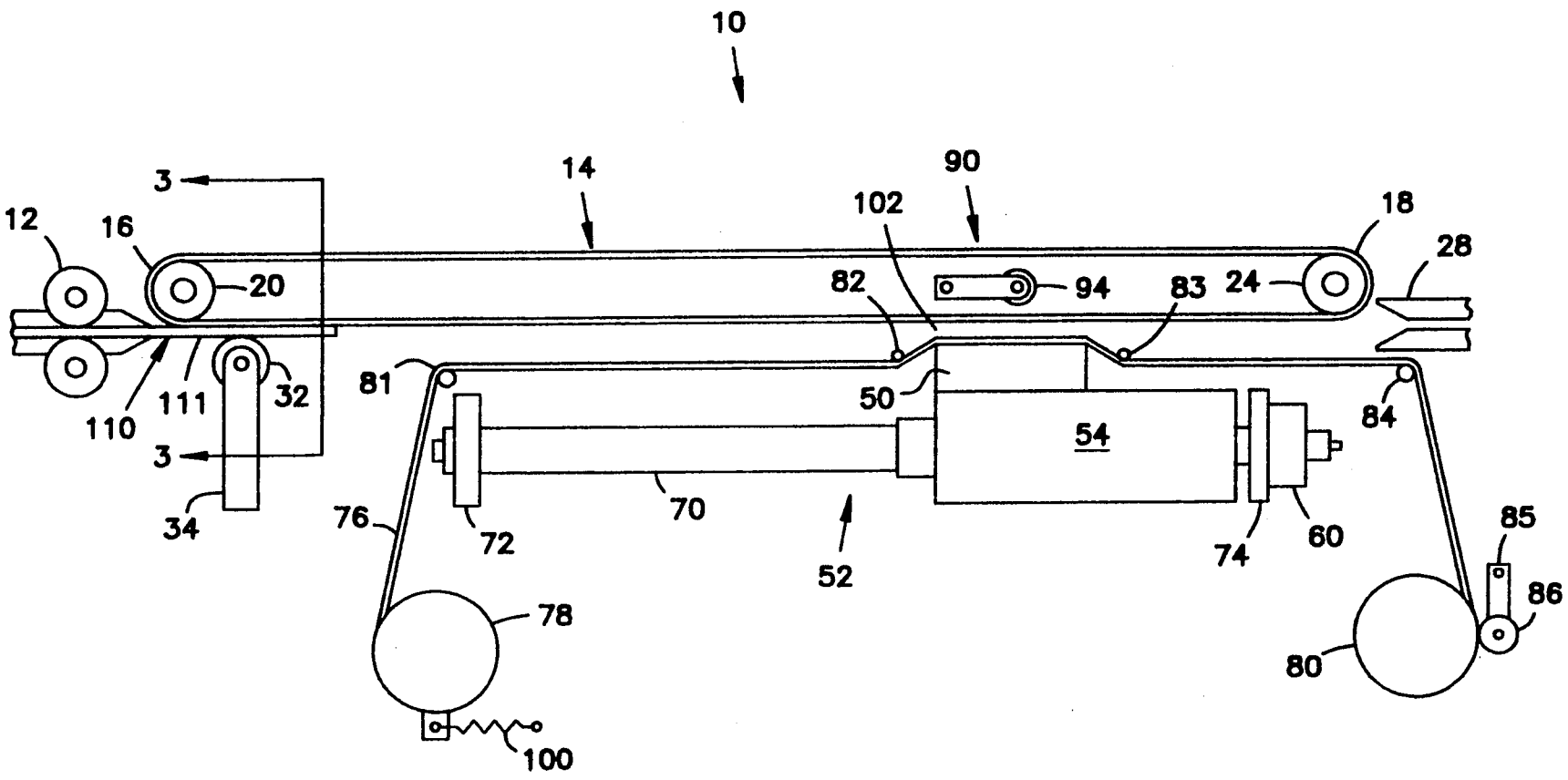
FIG. 2*a* is a top diagrammatical view of the printer apparatus shown in FIG. 1, showing a card as it enters the apparatus.

Referring to FIG. 2*a*, a diagrammatical representation of the printer apparatus 10, including a card manipulation apparatus 11, shows a credit card 110 being transferred from the infeed guide roller assembly 12 onto the card transport belt 14. As may be seen, the card 110 is pressed firmly onto the soft urethane surface of the transport belt 14 at the first end 16 of the belt 14 by a full card-height rubber roller 32 with adequate force so as to cause the card 110 to adhere to the surface of the belt 14, such force being in the range of 1–5 pounds. As previously stated, in the preferred embodiment the roller 32 also serves as a cleaning roller to remove loose particles from the card surface 111. The plastic card 110 adheres to the soft urethane coating of the transport belt 14 without the aid of additional adhesive materials such as a layer of glue or viscid substance. By transporting the card 110 on the transport belt 14 in this fashion, the printer apparatus 10 is able to process the entire exposed card surface 111 in any number of successive passes to obtain the tonal color image desired.

The transport belt 14 is shown as an endless loop belt, driven about a first guide pulley 20 and a second guide pulley 24. The thermal print head 50, which is situated alongside the transport belt 14 and which is mounted on a carriage assembly 52 for linear movement parallel to the transport belt 14, is not in contact with the transport belt 14.

The color transfer ribbon 76 in FIG. 2*a* is fed from the ribbon supply spindle 78, around a first ribbon guide bar 81, weaving around a first ribbon guide wire 82, through the gap 102 between the print head 50 and the transport belt 14, around a second ribbon guide wire 83, weaving to the opposite side of a second guide bar 84, and taken up by the ribbon takeup spindle 80. The gap 102 between the print head 50 and the transport belt 14 allows for movement of the card 110 through this area when printing is completed and allows the ribbon 76 to move between color panels.

The ribbon 76 is advanced through the printer apparatus 10 by a rubber capstan roller 86. The capstan roller 86 is situated on an end of a capstan roller arm 85. The capstan roller arm 85 pivots at its other end to bias the capstan roller 86 against the outside diameter of the used ribbon 76 as it is taken up by the takeup spindle 80, thereby squeezing out air between layers of ribbon 76 and producing a tight roll. Use of the capstan roller 86 as the drive for taking up the ribbon 76 ensures that a constant diameter is maintained regardless of the amount of ribbon 76 at either spindle 78,80, thereby maintaining a constant rate of ribbon movement across the print head 50. The ribbon 76 is advanced by the capstan roller 86 until a photo cell senses the presence of an index mark on the ribbon 76. The ribbon takeup spindle 80 is driven by a stepper motor through a two belt drive system until the desired color panel is in the correct position.

Tension is maintained on the ribbon 76 by a takeup spring 100 acting on the supply spindle 78. The spring 100 also acts to absorb any shocks to the ribbon 76 due to sudden capstan roller movement. At the other end of the system, the ribbon drive motor is acceleration profiled to reduce breaks or stretching of the ribbon 76 due to sudden movement of the capstan roller 86.

FIG. 2*a* also shows a pressure roller 94 positioned opposite the thermal print head 50 on the inside of the transport belt 14. The pressure roller 94 is engaged only when printing on the card 110 is actually taking place.

Figure 2B:
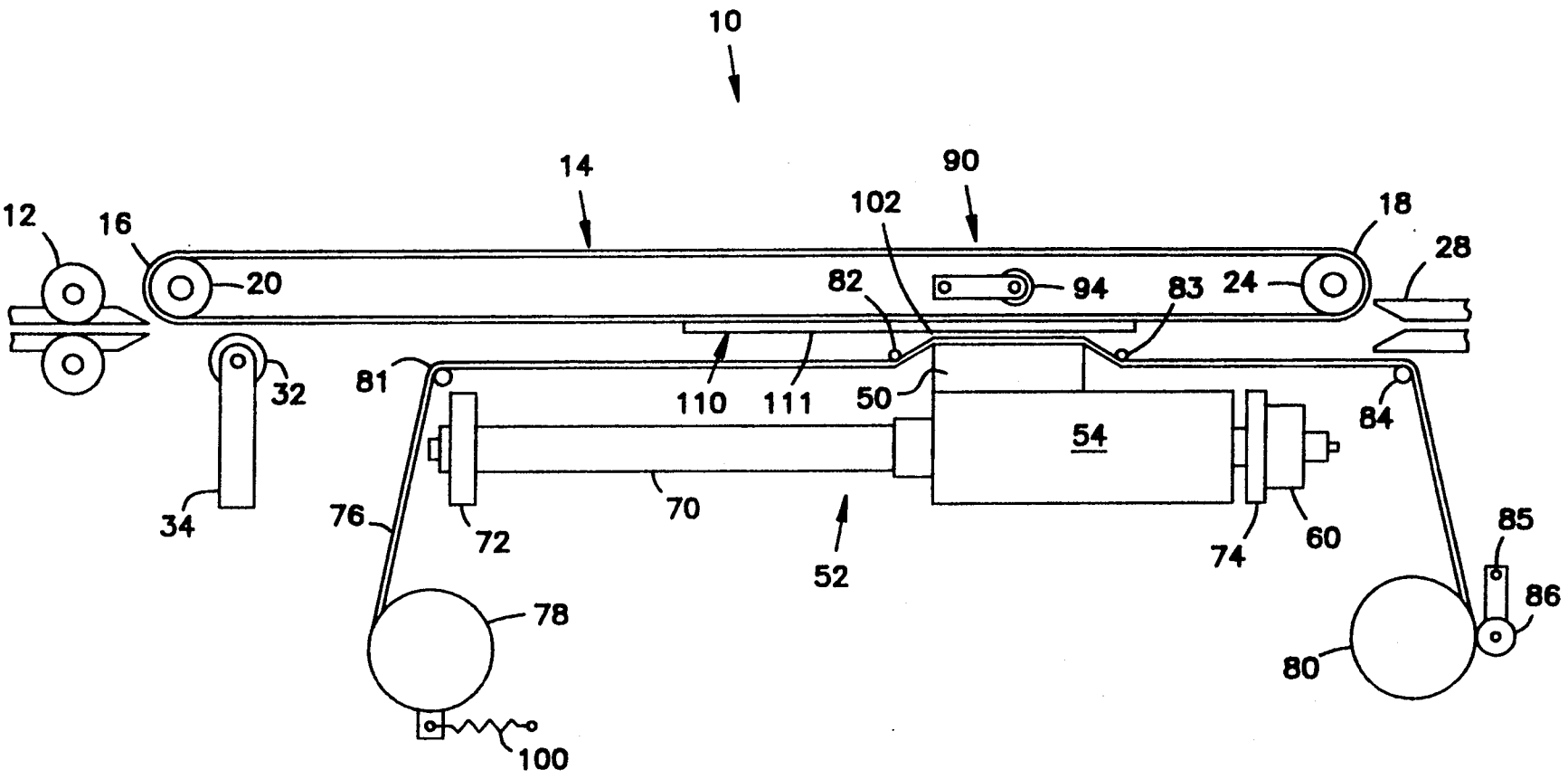
FIG. 2*b* is a top diagrammatical view of the printer apparatus shown in FIG. 1, showing a card in position for printing.

Referring now to FIG. 2*b*, the card 110 is fully transferred onto the transport belt 14 and the cleaning roller 32 is withdrawn away from the belt 14. The transport belt 14 continues to move the card 110 toward the second end 18 of the belt 14 until the card 110 is positioned with the thermal print head 50 for printing, at which point the transport belt 14 stops moving. As indicated in FIG. 2*b*, a small gap 102 is maintained between the card 110 and the transfer ribbon 76 and thermal print head 50 while the card 110 is being moved by the transport belt 14.

Figure 2C:
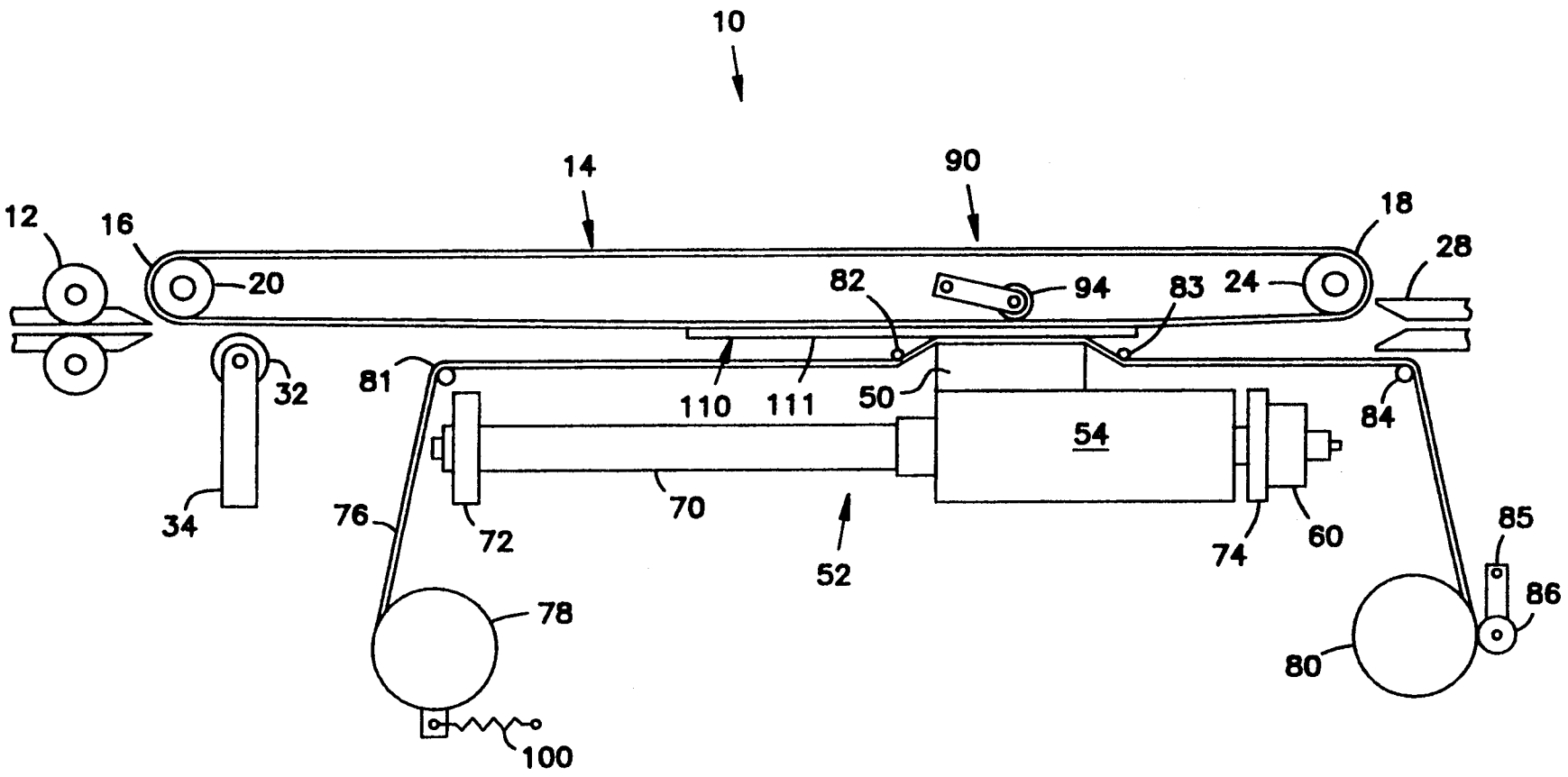
FIG. 2*c* is a top diagrammatical view of the printer apparatus shown in FIG. 1, showing a card during the printing operation.

FIG. 2*c* illustrates a printing step utilizing the present invention. In the preferred embodiment when performing tri-color printing, the ribbon 76 is advanced to a first color panel, which in this example is the color yellow. The advancement of the ribbon 76 is controlled as follows. The printer apparatus 10 includes a ribbon index bar photo cell which reads identifying bars on the edge of the ribbon 76. Once the bar photo cell identifies the initial bar of each color set, the ribbon takeup motor counts a predetermined number of steps to properly position the ribbon 76 for printing. The second photo cell at the supply spool monitors the number of transitions and uses this information to check for slipping and possible ribbon breaks.

Once the first color is positioned properly, the pressure roller 94 is brought into contact with the inner surface 116 of the transport belt 14 to apply force against the thermal print head 50, the pressure roller force typically being 10–30 pounds. The yellow image is transferred onto the card 110 as the thermal print head 50 moves down the linear bearing supports 70. As the print head 50 moves, the ribbon 76 is separated from the card surface 111 by the outfeed, or second, ribbon guide wire 83 positioned at the side of the print head 50. By separating the ribbon 76 from the card 110 before the ribbon 76 and card 110 cool off, higher printing energy levels are made possible, thereby allowing for a higher contrast on the produced images and a higher card production level.

Upon completion of the yellow color pass, the pressure roller 94 is disengaged, the remaining transfer ribbon 76 is separated from the card surface 111 by one of the ribbon guide wires 82,83 due to continued movement of the print head 50, and the ribbon 76 is advanced to the next, or magenta, color panel. The print head 50 is returned to the home position and printing of the magenta color image is initiated. The above-described steps are repeated to complete each of the individual color passes in this example.

Minute linear movement of the belt 14 along its direction of travel caused due to the drag produced by the print head 50 over the face of the card 110 is controlled by the resistive force of the belt drive motor. An alternative embodiment of the invention may include a belt clamp device which mechanically engages the surface of the belt 14.

Figure 2D:
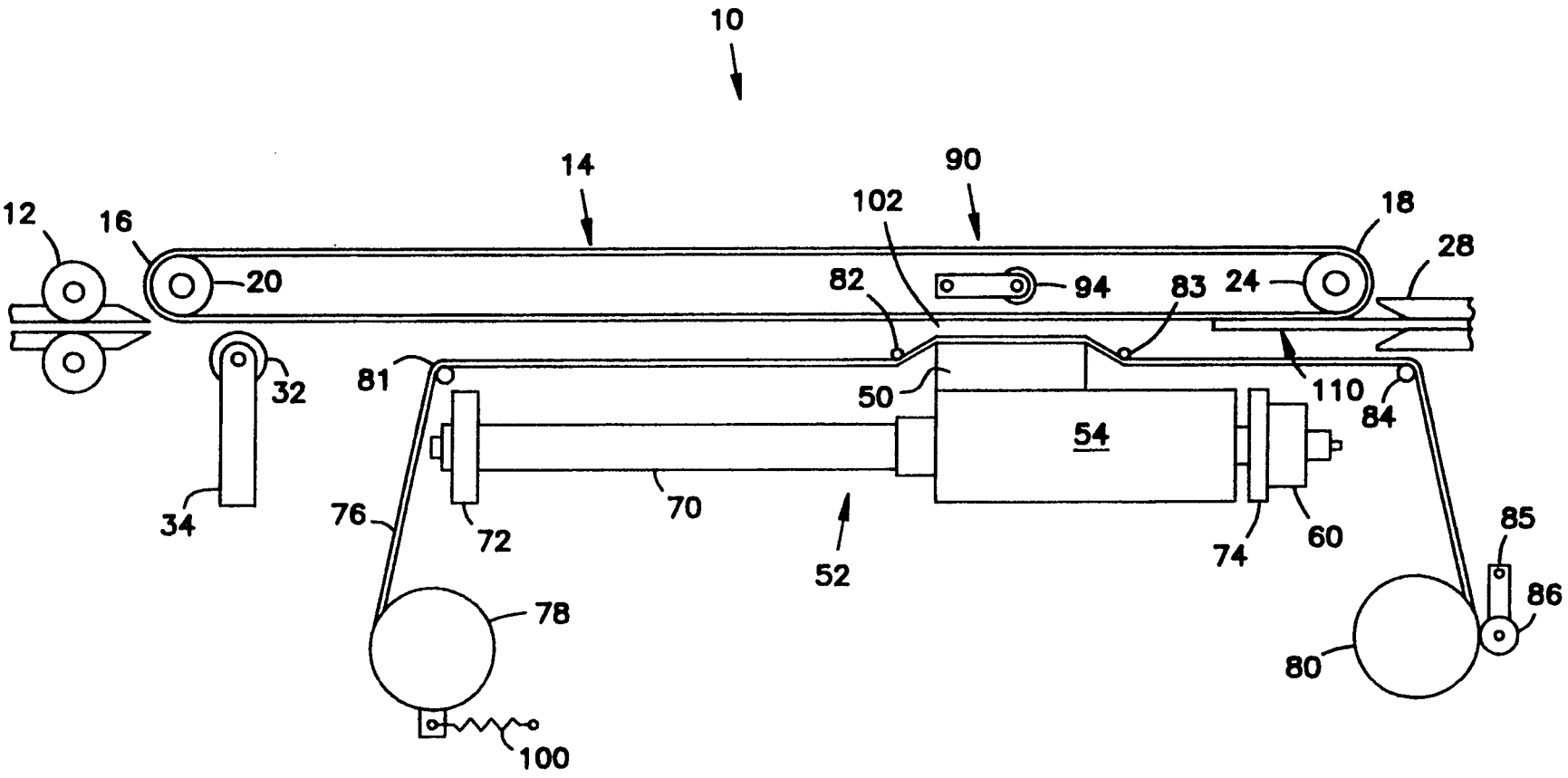
FIG. 2*d* is a top diagrammatical view of the printer apparatus shown in FIG. 1, showing a card as it exits the apparatus.

After the print head 50 has completed all of the desired passes, the pressure roller 94 is disengaged and the print head carriage 54 is returned to the home position as shown in FIG. 2*d*. The belt motor is run and the card 110 is advanced toward the second end 18 of the transport belt 14. As the transport belt 14 rounds the second guide pulley 24, the outer layer 120 of urethane in the belt 14 is stretched, causing the card 110 and the belt 14 to separate. The card 110 is then transferred into the outfeed guide roller assembly 28 to wait for the command to transfer the card 110 into the next card processing station or for manual removal of the card 110.

Figure 3:
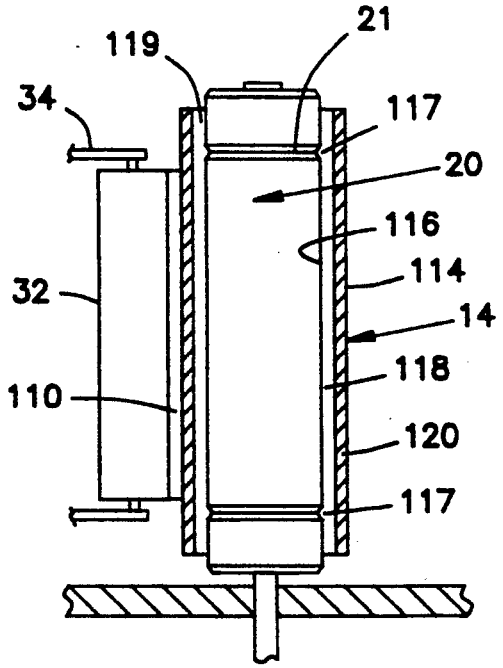
FIG. 3 is a top diagrammatical view of an alternate embodiment of the present invention showing a transport belt which is taken up by pulleys at both ends of the belt.

As may be seen in FIG. 3, which is a cross-sectional view of the transport belt 14 and first guide pulley 20 taken along line 3—3 in FIG. 2*a*, the transport belt 14 includes a smooth outer card receiving surface 114 and an inner surface 116 configured to engage the guide pulley 20. A simple flat belt will "walk" with respect to the guide pulleys, thereby causing misalignment of the card 110 with the print head 50. Therefore, two sets of ribs 117 are formed on the inner surface 116 of the transport belt 14. The ribs 117 engage corresponding grooves 21 formed in the first guide pulley 20 and the second guide pulley 24 to ensure that proper vertical tracking with respect to the infeed guide roller assembly 12 is maintained. The grooves 21 are situated near the top and bottom edges of the transport belt 14 such that the distance between the grooves 21 is typically equivalent to the height of the credit card 110 being printed. Furthermore, the height of the pressure roller 94 also corresponds to the height of the card 110 being printed upon; therefore, the pressure roller 94 does not require any grooves to mate with the inner surface 116 of the transport belt 14.

An alternative embodiment for maintaining correct alignment of the belt 14 with the infeed roller assembly 12 and the print head 50 is to use a true crowned roller in conjunction with a flat belt.

The transport belt 14 of the preferred embodiment is composed of two layers, as may also be seen in FIG. 3. The inside layer 118 of the transport belt is a 70 to 90 durometer shore A urethane elastomer reinforced with a layer of fibers 119 made of a tough, flexible material such as Kevlar ®. The layer of reinforcing fibers 119 is located just below the smooth surface of the inside layer 118 opposite the ribbed side 116. The outside layer 120 is a 10 to 20 durometer shore A urethane elastomer with a 5 percent plasticizer. The low level of plasticizer is needed to maintain good tear and abrasion strength. The inside layer 118 of the belt 14, including the reinforcing layer 119, is stiffer than the soft outside layer 120. The neutral axis of the belt 14 is located near the reinforcing layer 119; therefore, the outside layer 120 is stretched more than the inside layer 118 as the belt 14 is drawn around the outfeed guide pulley 24. The differential stretching of the outside layer 120 causes the card 110 to become disengaged from the stretched belt surface.

It is to be appreciated that there may be numerous alternatives as to the composition and configuration of the two layers which comprise the transport belt 14, particularly in regard to the inner layer 118, and that the two layers may be bonded in numerous ways. For instance, the inner layer 118 may be made of any substance similar in properties to urethane, and may be formed in a broad v-shape. A few examples of how the layers may be bonded may include using a molding process, rubber adhesive, or adhesive tape.

Figure 4:
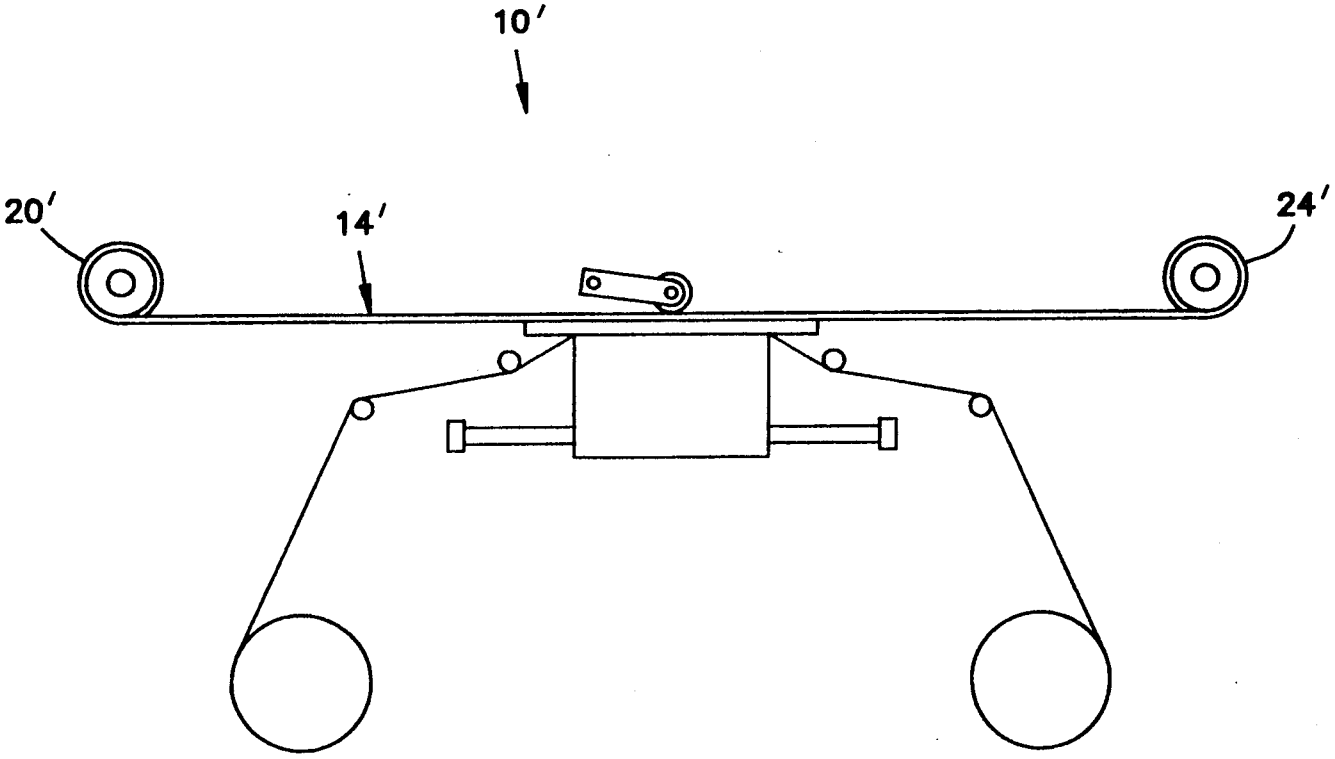
FIG. 4 is a block diagram of an alternative embodiment of the present invention showing multiple print heads.

As illustrated in FIG. 4, an alternative embodiment of the transport belt 14 may include a non-looping belt 14' in which each end of the belt 14' is either wound or unwound upon guide pulleys 20',24' to cause lateral movement of the belt 14'.

Figure 5:
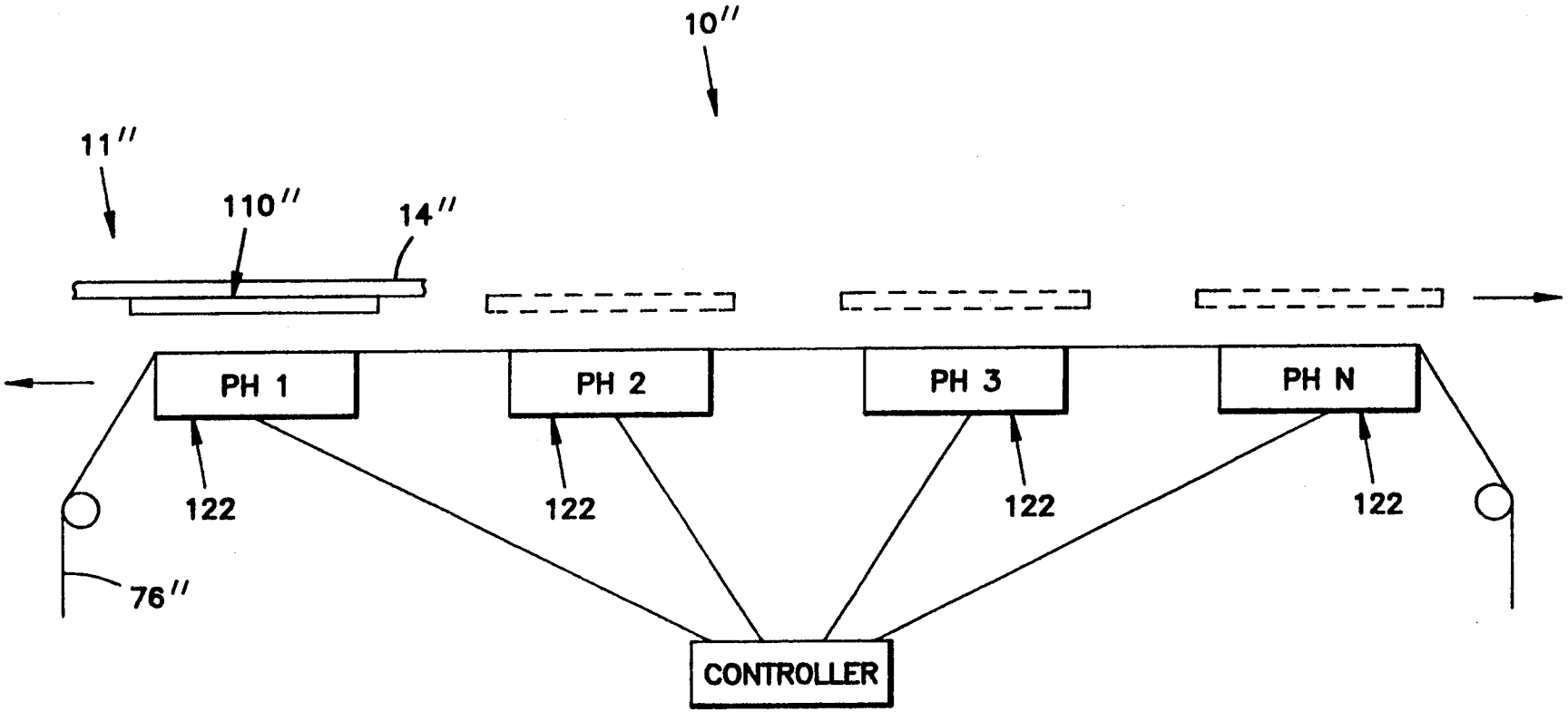
FIG. 5 is a side elevational view in cross-section of the transport belt and pulley taken along the line 5—5 in FIG. 2*a;*

FIG. 5 is a block diagram showing an alternate embodiment 10'' of the present invention with a card manipulation apparatus 11'', wherein multiple print heads 122 are employed to transfer the color to the card 110''. In this embodiment, either the print heads 122 or the card transport belt 14'' may be moved during the print operation. For instance, in a multi-color print operation in which the card 110'' and belt 14'' are stationary and the print heads 122 are moveable, the first print head 122 would be moved into position over the card 110'' to print a first color onto the card 110''. Upon completion of the first color print pass, the transfer ribbon 76'' would be advanced, to position a second color section over the card 110'', and the second print head 122 would move until positioned over the card 110'' to print the second color image onto the card 110''. This process could continue any number of times until the color image is complete.

In the case in which the multiple print heads 122 are maintained in a fixed position during the print operation while the card 110'' and belt 14'' are moved, the process is similar to that described above except that it is the card 110'' that moves during printing, not the print head 122.

Figure 6:
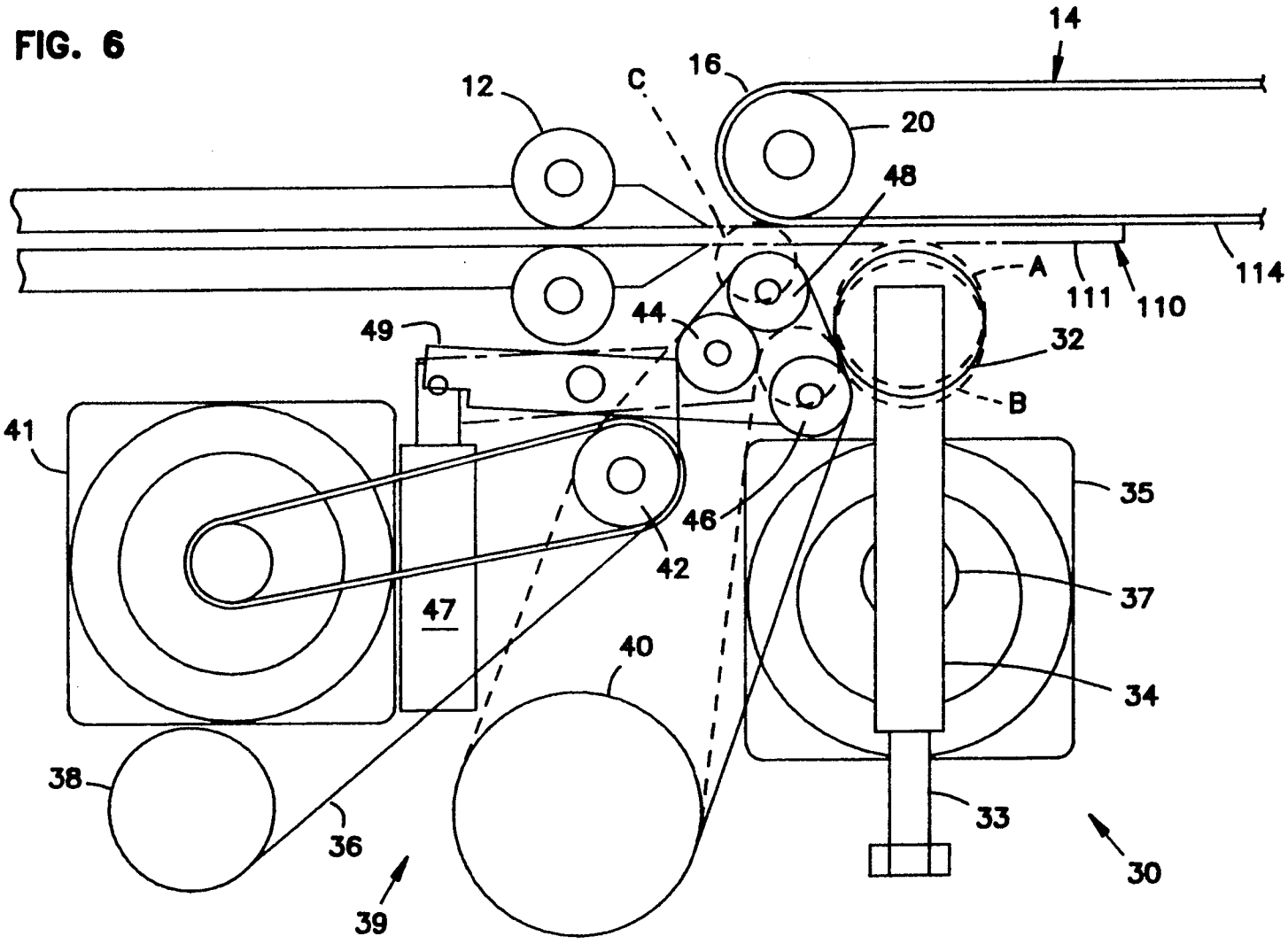
FIG. 6 is a top diagrammatical view of the card and transport belt cleaning apparatus shown in FIG. 1.

FIG. 6 is similar to FIG. 2*a* in that a card 110 is being transferred from the infeed guide roller assembly 12 onto the transport belt 14. As previously noted, the roller 32 which presses the card 110 onto the soft urethane surface of the belt 14 at position "A" also performs a cleaning operation on the print surface 111 to remove loose particles prior to printing. The cleaning roller 32 is shown mounted on a cleaning roller carriage assembly consisting of a carriage block 34 which slides upon guide shafts 33. The cleaning roller carriage 34 is positioned by a motor 35 situated beneath the carriage block 34. The motor 35 engages an eccentric cam 37 which acts on the carriage block 34 such that the block 34 is moved either toward or away from the transport belt 14 and card 110.

Also shown in FIG. 6 is a cleaning tape apparatus 39 which is used for removing loose particles collected on the cleaning roller 32, and which is also used for cleaning the surface of the transport belt 14 of loose particles and debris. The cleaning tape 36 is deployed from the cleaning tape supply spindle 38, whereupon the tape 36 is routed by two tape drive rollers 42,44 and two idler rollers 46,48 and terminates at the cleaning tape takeup spindle 40. A motor 41 drives the first tape drive roller 42 via a belt drive 43. The tape takeup spindle 40 is driven by a secondary timing belt 45 driven by the first tape drive roller 42.

A solenoid 47 and actuating arm 49 are associated with the idler rollers 46,48 for bringing the cleaning tape 36 into contact with the card retaining surface 114 of the transport belt 14. The shaft of the solenoid is pivotally mounted at one end of the actuating arm 49 which likewise pivots around a pivot point 51 in the base of the printer apparatus 10. The second end of the actuating arm is provided with an 1-shaped extension, and it is upon this extension that the idler rollers 46,48 are situated.

FIG. 6 illustrates cleaning of the cleaning roller 32 by the cleaning tape 36. The cleaning roller 32 and carriage 34 are retracted along the guide shafts 33 to the position "B" until the cleaning roller 32 engages the cleaning tape 36 passing around the rear idler roller 46.

FIG. 6 also illustrates cleaning of the transport belt 14 by the cleaning tape 36. The solenoid 47 is activated, causing the solenoid shaft to act against the activating arm 49, thereby causing the arm 49 to pivot about the pivot point 51. The extension of the activating arm 49 is pivoted toward the transport belt 14, thus bringing the cleaning tape 36 at the forward idler roller 48 into engagement with the transport belt 14 at position "C".

It should be noted that the cleaning roller 32 may be cleaned simultaneously with the transport belt 14 as may be envisioned from the configuration of components in FIG. 6.

Figure 7:
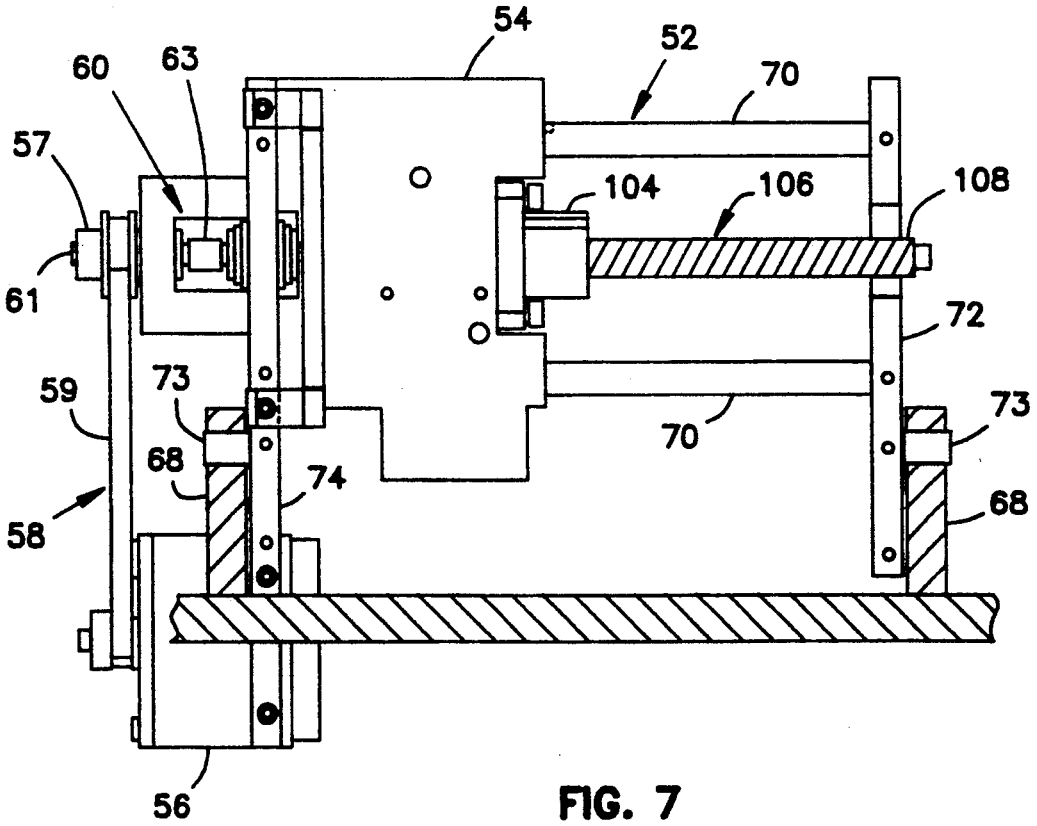
FIG. 7 is a front elevational view of the thermal print head carriage assembly shown in FIG. 1.

Referring now to FIG. 7, which illustrates the thermal print head carriage assembly 52, there is shown a carriage block 54 which is slideably mounted on linear bearing shafts 70. The linear movement of the carriage block 54 is parallel to the transport belt 14. The linear bearing shafts 70 are mounted at each end into carriage supports 72,74. The carriage supports 72,74 are provided with pivot pins 73, the purpose of which will be discussed in a section to follow.

Figure 8:
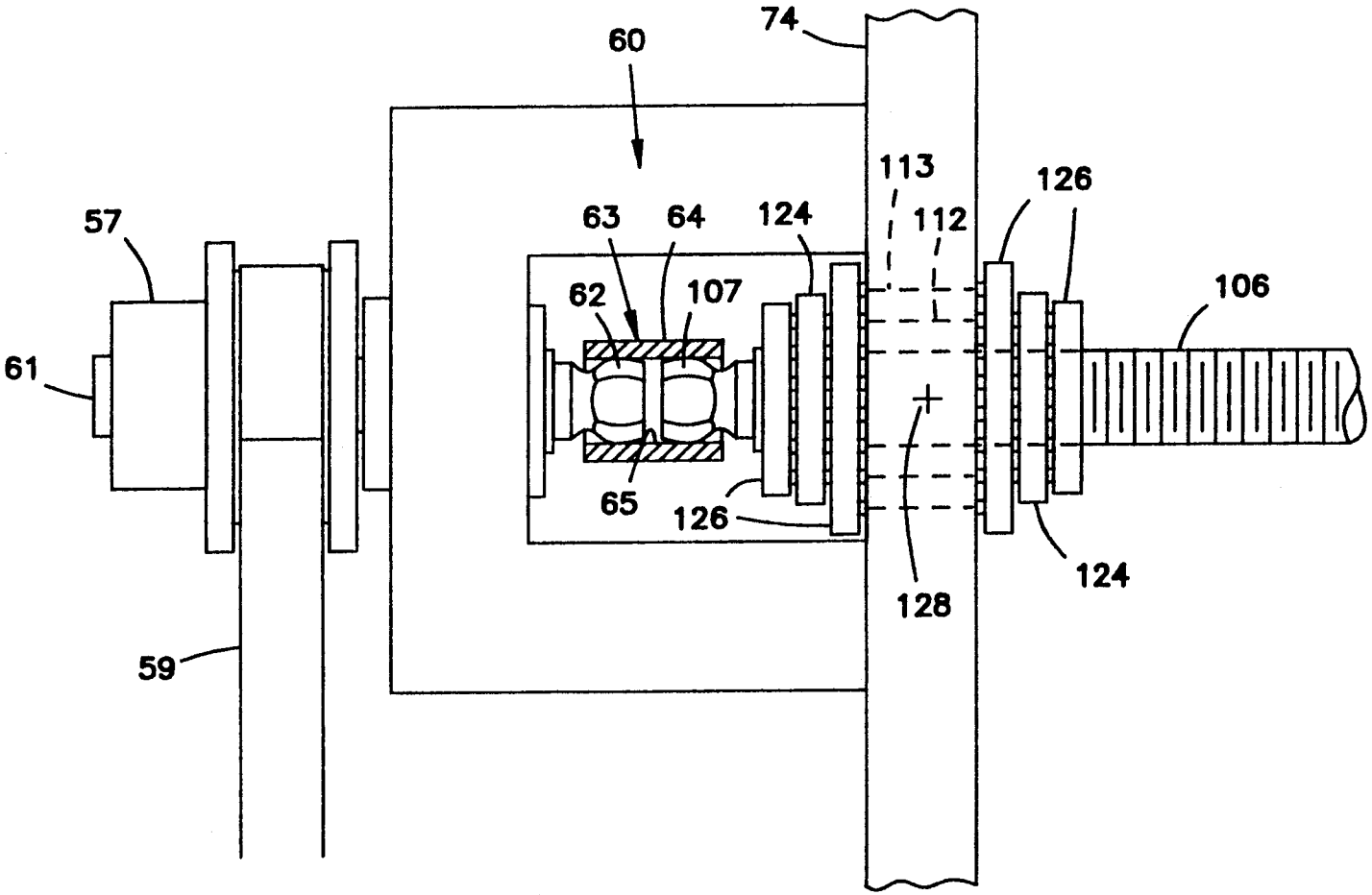
FIG. 8 is an enlarged front elevational view in cross-section of a portion of the thermal print head carriage assembly shown in FIG. 7.

In the preferred embodiment of the present invention, the movement of the carriage block 54 along the linear bearing shafts 70 is produced by a stepper motor 56 which drives a ball nut 104 and lead screw 106 combination. As shown in FIG. 7, a timing pulley set 57 and timing belt 59 attach the stepper motor 56 to a jack shaft 61 that in turn drives a constant velocity coupling 63. The coupling 63 mates the output end 62 of the jack shaft 61 with the input end 107 of a lead screw 106. The lead screw 106 is basically a threaded shaft which accommodates a ball nut 104. Is shown in FIG. 8, the coupling drive shaft 64 is a hollow shaft with a hex bore 65. The output end 62 of the jack shaft 61 and the input end 107 of the lead screw 106 are spherical hex shapes that loosely fit in the hex bore 65 of the coupling drive shaft 64. The spherical hex shapes provide a constant angular velocity of the lead screw 106 should the lead screw shaft precess, or wobble around the preferred axis of rotation, as the lead screw 106 turns during operation. The coupling 63 is provided with a loose fit to assist in transferring torque and preventing any normal forces to the lead screw shaft end 107 which may cause defects in the printed image.

Referring still to FIG. 8, the lead screw 106 is mounted in a double race ball bearing 112 which is mounted in a spherical bearing 113 in a carriage support 74. Ball thrust bearings 124 and washers 126 are situated on each outboard side of the spherical bearing 113. This configuration provides an absolute origin point 128 about which the carriage 54 may move with respect to the lead screw 106. Only the drive end 107 of the lead screw 106 is mounted in a bearing. The opposite end 108 of the lead screw 106 is free to move. This design is incorporated into the preferred embodiment to accommodate the effect of the secondary helix which is commonly formed in lead screw shafts during their manufacture, and which would cause minor defects in a printed image.

The ball nut 104 is mounted on the carriage block 54 and cooperates with the lead screw 106 such that as the lead screw 106 is rotated by the stepper motor 56, the carriage block 54 is caused to move in the corresponding linear direction.

Figure 9A:
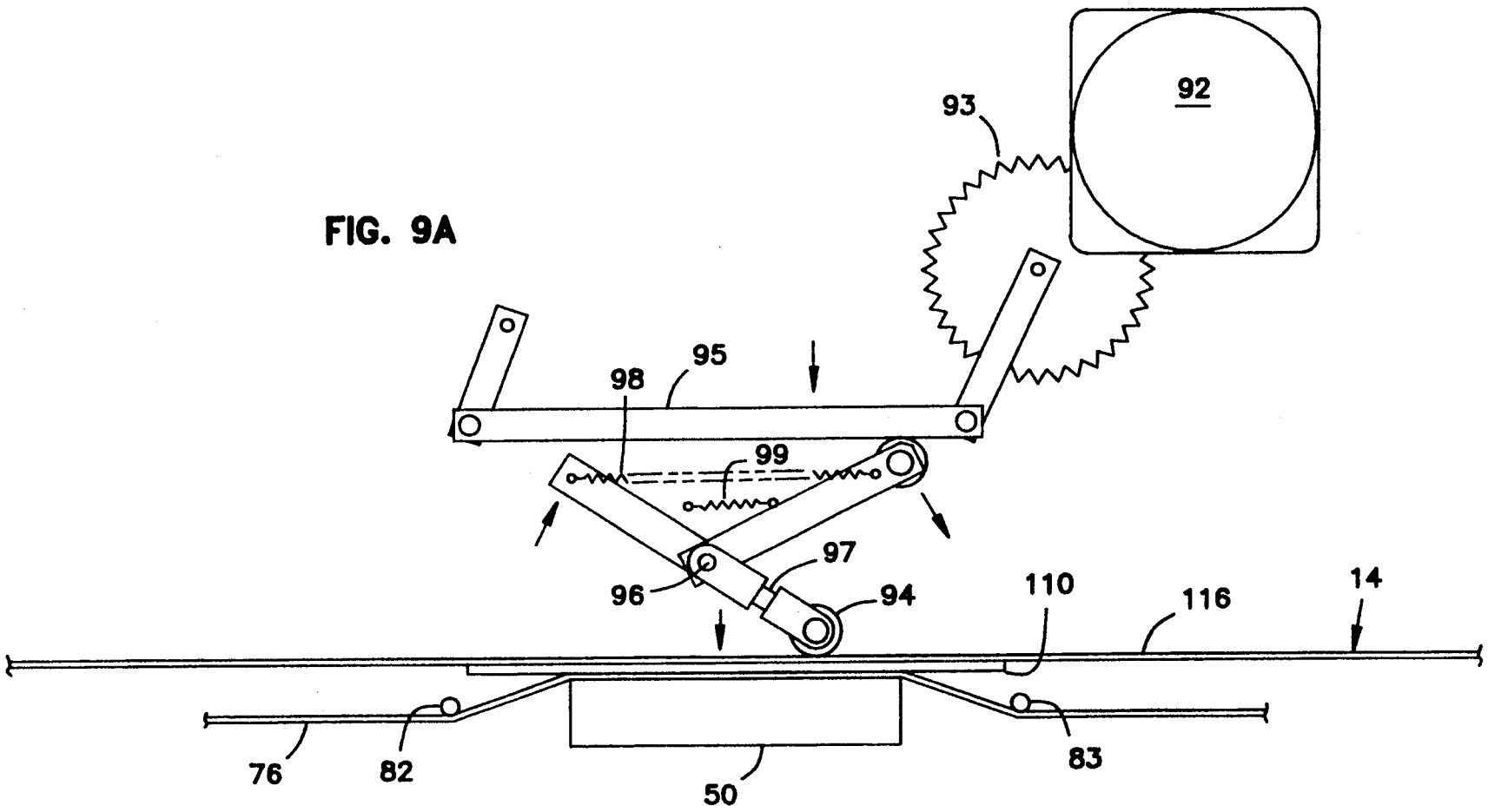
FIG. 9*a* is a top diagrammatical view of the pressure roller assembly shown in FIG. 1, showing the pressure roller at rest.
Figure 9B:
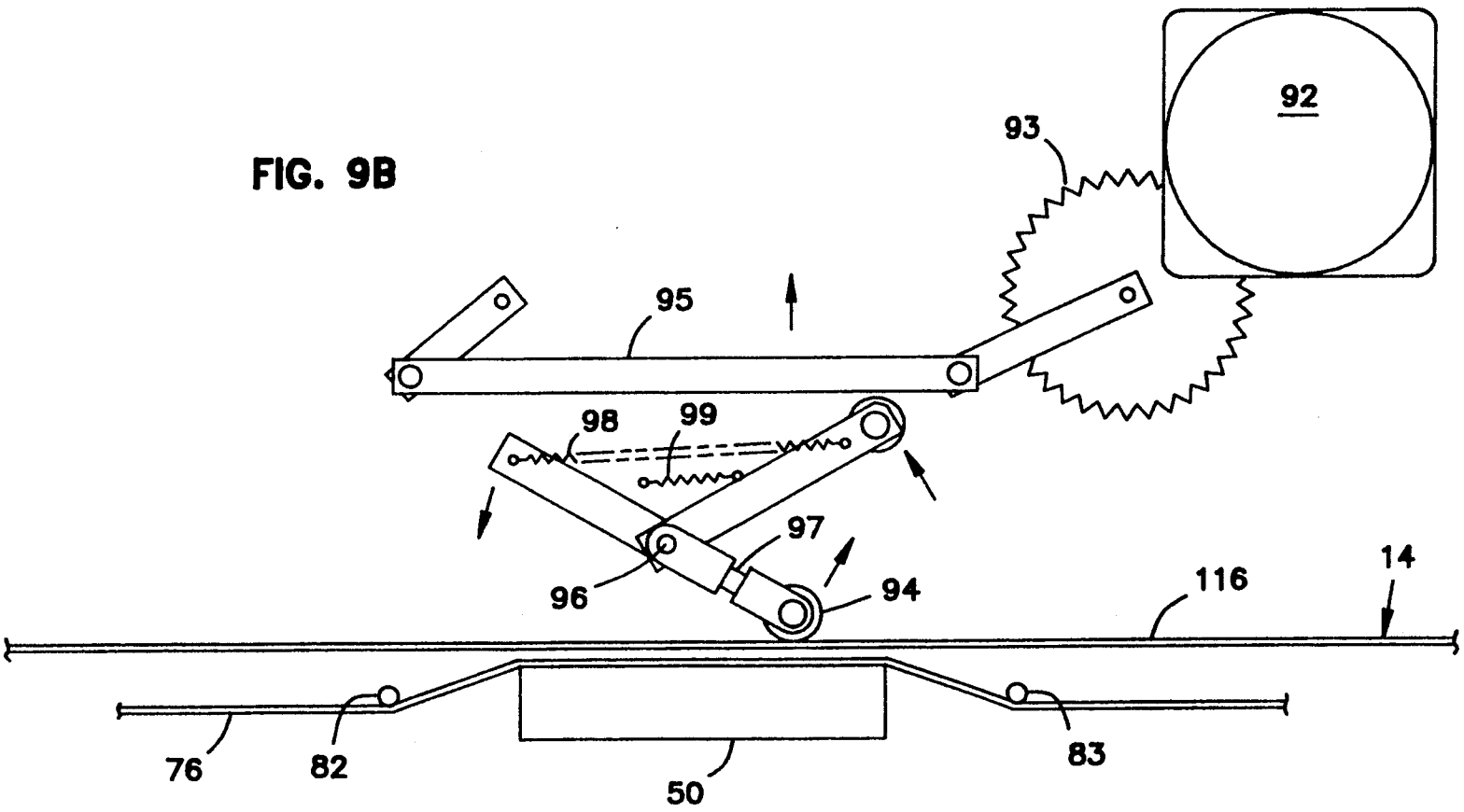
FIG. 9*b* is a top diagrammatical view of the pressure roller assembly shown in FIG. 1, showing the pressure roller engaged during the printing operation.

In the preferred embodiment, a pressure roller 94 is provided for exerting a force during printing of a card 110 against the inner surface 116 of the transport belt 14 in direct opposition to the thermal print head 50 on the opposite side of the transport belt 14. As illustrated in FIG. 9*a*, a stepper motor 92 acts upon a set of gears 93 which in turn transfer force to a linkage 95 which terminates at one end of a pressure roller shaft 96. The pressure roller 94 is mounted to the second end of the roller shaft 96 and is provided with a gimbal device 97 to allow the roller 94 to follow variations in the thickness of the transport belt 14 or card 110, or twisting of the same. A tension spring 98 biases the pressure roller 94 against the inner surface 116 of the transport belt 14 to create adequate force of 10–30 lbs for producing the desired image. Use of the spring 98 also allows reciprocal movement of the pressure roller 94 due to variations in the thickness of the belt 14 or debris. FIG. 9*b* shows the pressure roller 94 disengaged from the transport belt 14. The roller 94 and linkage 95 are biased into disengagement from the transport belt 14 by a return spring 99.

Figure 10:
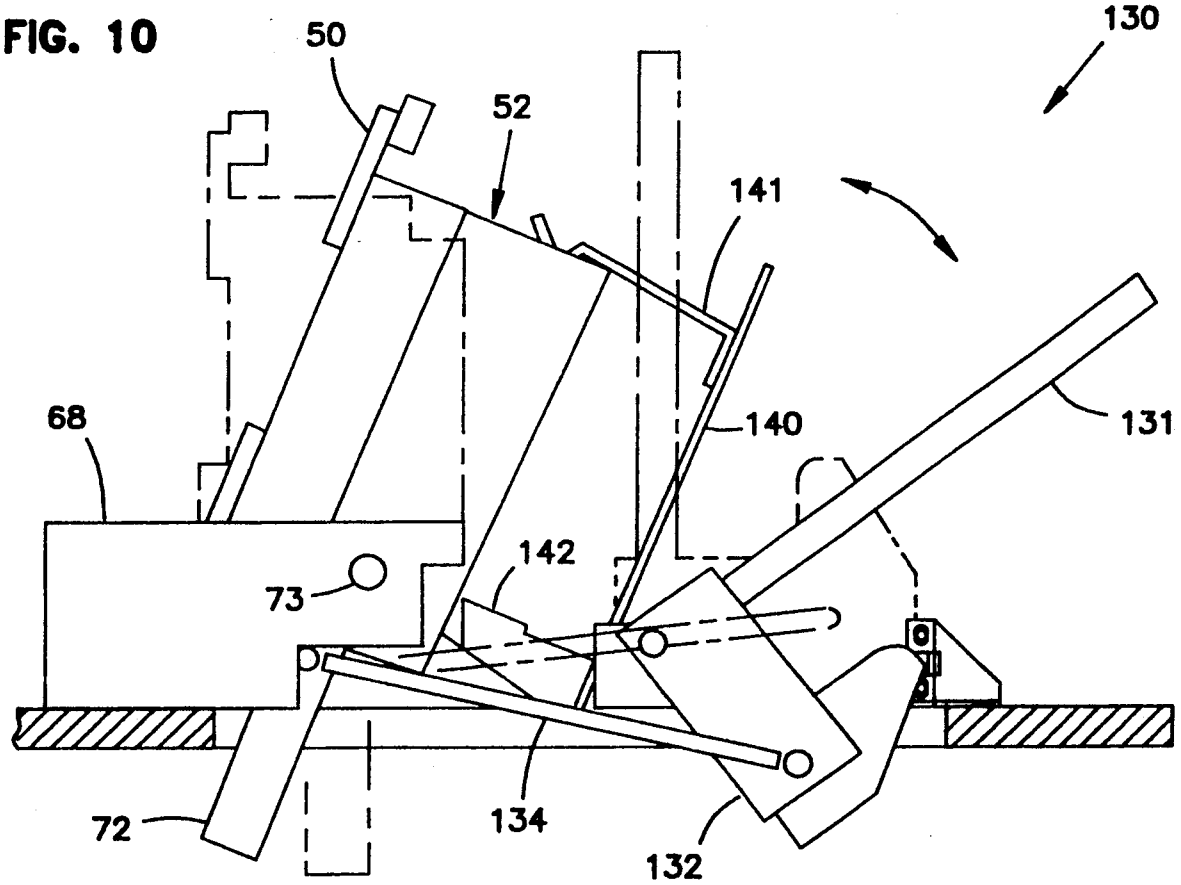
FIG. 10 is a side elevational view of the thermal print head and carriage assembly of the printer apparatus shown in FIG. 1, illustrating a tilt mechanism for accessing the transfer ribbon and print head.

The printer apparatus 10 includes a tilting mechanism 130 for accessing the area between the thermal print head 50 and the transfer ribbon 76 to enable easy removal of these consumable components by the operator. As shown in FIG. 10, an actuating lever 131 is pivotally mounted at its base and includes an arm 132 on which is mounted one end of a tension spring member 134. The other end of the tension spring member 134 is mounted for pivotal movement to the carriage support 72. The carriage supports 72, and therefore the entire carriage assembly 52, pivot about pivot pins 73 provided in the carriage supports 72 when the actuating lever 131 is pulled downwardly. The pivot pins 73 are rotateably mounted in carriage support blocks 68 adjacent to each carriage support 72. By pivoting the print head carriage assembly 52 away from the transport belt 14, access is gained to the area between the components thereby simplifying replacement of the transfer ribbon 76 and print head 50.

Figure 11:
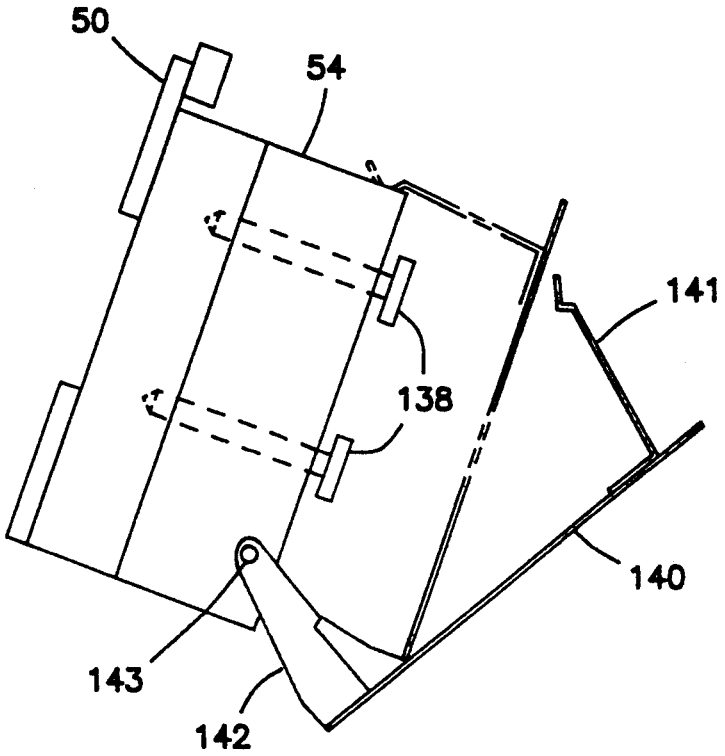
FIG. 11 is a side elevational view of the thermal print head and carriage assembly of the printer apparatus shown in FIG. 10, illustrating a regulator circuit board which pivots to allow access to the print head mounting hardware.

Access is gained to the thumb screws 138 which mount the print head 50 to the carriage block 54 by pivoting a regulator circuit board 140 away from the back of the print head carriage block 54, as shown in FIG. 11. The regulator circuit board 140 is mounted to the carriage block 54 by a latch 101 at an upper end of the regulator board 140 and by two pivot arms 142, each located near a lower corner of the regulater board 140. The pivot arms 142 are pivotally mounted at one end to the carriage block 54 at pivot points 143. To access the print head mounting screws 138, the latch 141 is disengaged from the carriage block 54, thereby allowing the upper end of the regulator board 140 to pivot away from the carriage block 54, exposing the heads of the screws 138 as shown in FIG. 11.

Figure 12:
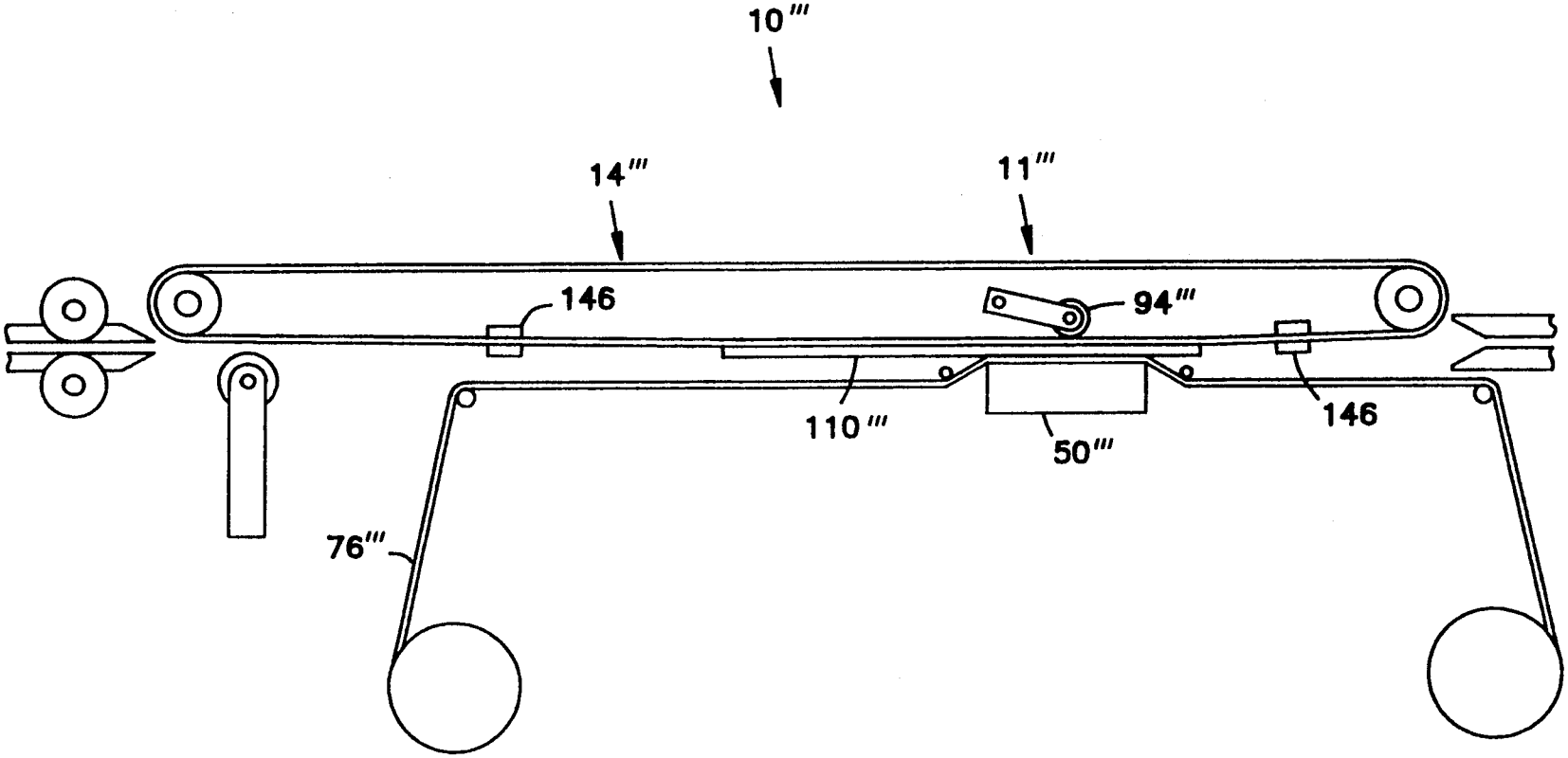
FIG. 12 is a top diagrammatical view of an alternate embodiment of the present invention showing a transport belt carriage assembly.

An alternative embodiment of the present invention as shown in FIG. 12 may provide for a printer apparatus 10''' including a card manipulation apparatus 11''' utilizing a soft elastomer card transport belt 14''' as disclosed above, wherein the print head 50''' is fixed during the printing operation. In this embodiment, the card 110''' is transported into the predetermined position for printing adjacent the print head 50''' by the transport belt 14'''. The belt 14''' is then grasped by a clamping device 146 which is mounted to a carriage system. The carriage system is in turn reciprocally driven in a linear direction parallel to the print head face, causing the transport belt 14''', and therefore the card 110''', to be moved across the stationary print head 50''' during the printing operation.

Figure 13:
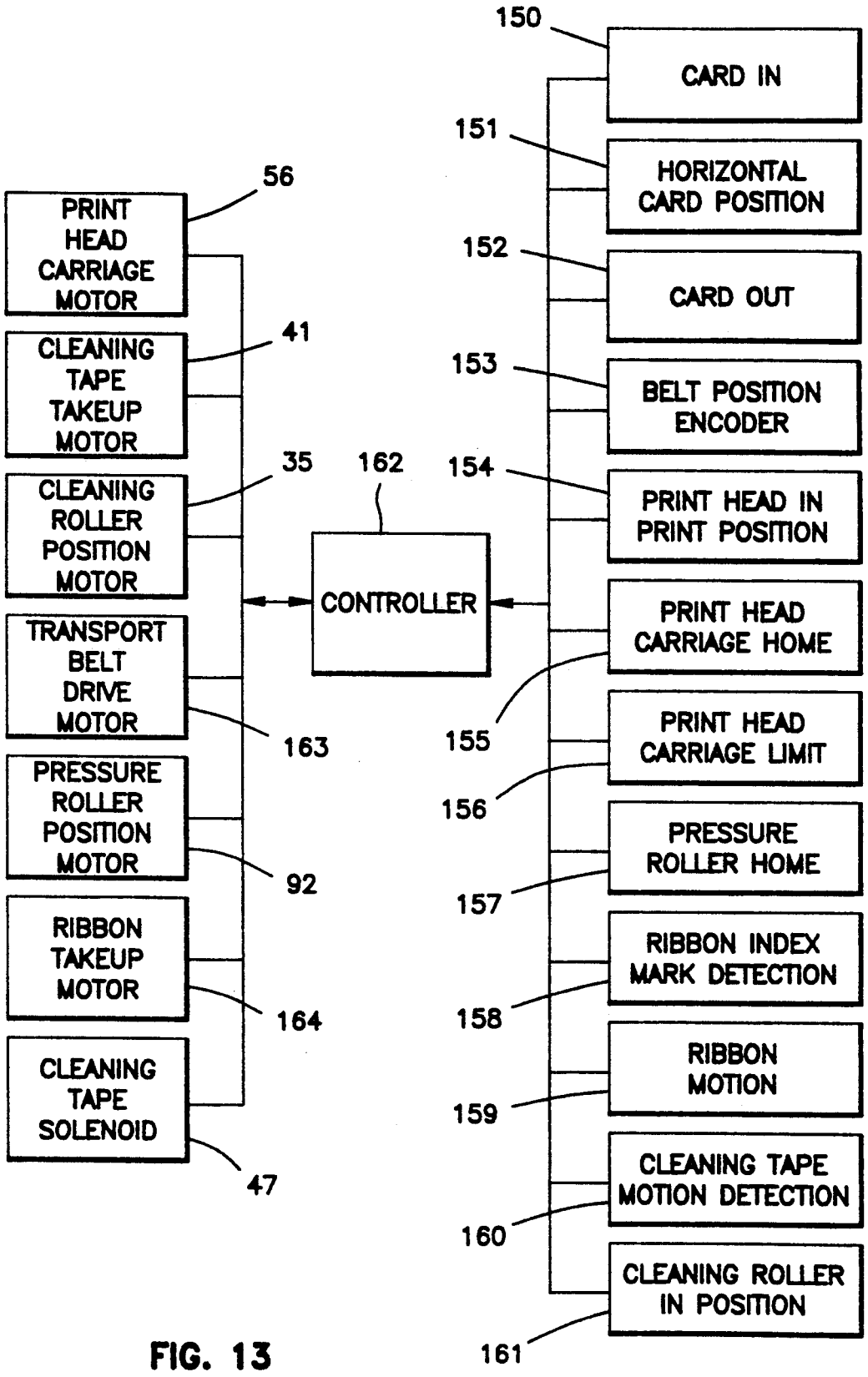
FIG. 13 is a block diagram of the sensor input to the system controller and motor input and feedback of the printer apparatus in accordance with the present invention.
Figure 14:
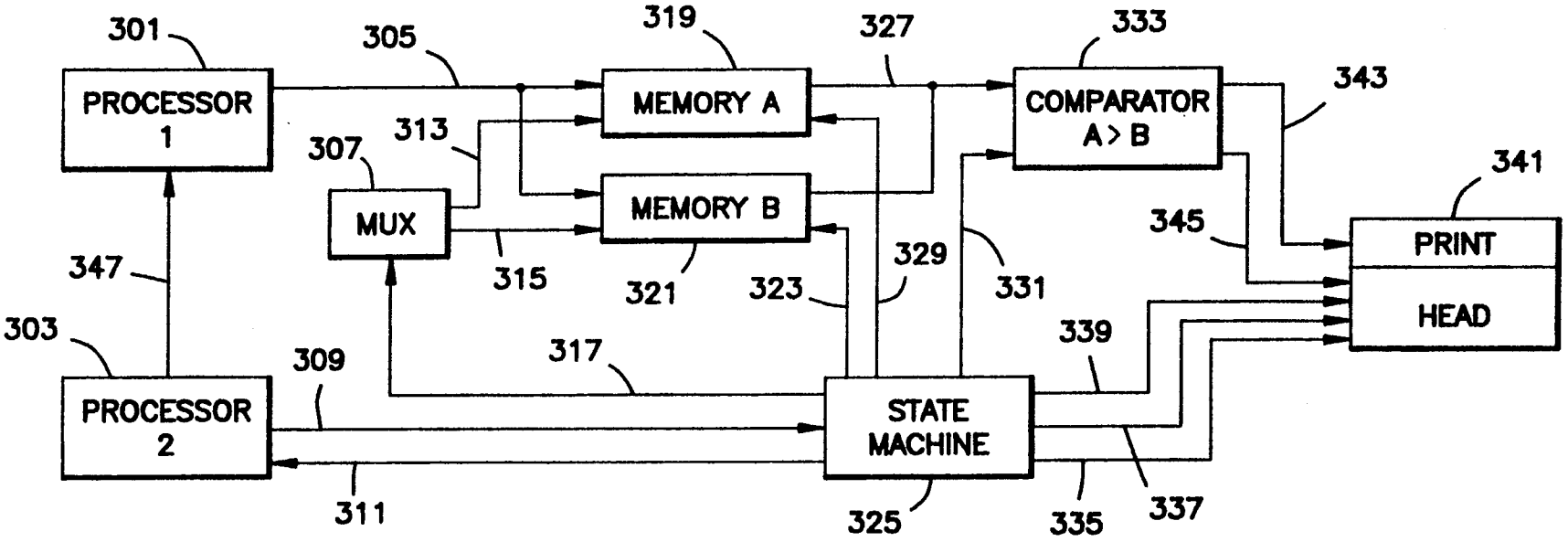
FIG. 14 is a schematic diagram of a print head controller in accordance with the present invention.

The preferred embodiment utilizes 14 photocells and sensors for monitoring the operation of the printer apparatus 10. FIG. 13 illustrates the sensors feeding information into the system controller 162, which in turn selectively communicates with the various motors and solenoid that drive the components of the above-described apparatus. An operation sequence for multicolor printing in accordance with the above-described preferred embodiment of the present invention, identifying the sensors and corresponding motors or solenoids, is described heretoafter.

Before operation of the printer apparatus 10 can begin, the print head must be latched in its proper vertical position by the tilting mechanism 130, this position being determined by a print-head-in-print-position sensor 154, located near the tilting mechanism actuating lever 131.

A credit card 110 is fed into the printer apparatus 10 via the infeed guide roller assembly 12, blocking the infeed "CARD IN" photo cell 150. The printer apparatus 10 checks the state of the horizontal card position photo cell 151 to ensure that it is blocked. The system 10 is commanded to run the infeed guide roller/belt drive motor 163 a predetermined number of steps (in this embodiment, 711 steps) until the "CARD IN" photo cell 150 changes to low stage, or when the card 110 has passed the first sensor 150. At this point, the printer apparatus 10 begins counting steps to move the card 110 out of the infeed guide roller assembly 12, to be pressed onto the surface of the transport belt 14, and to the correct stopping position. The position of the cleaning roller 32, which is used to press the card 110 onto the transport belt 14, is detected by a cleaning roller position photocell 161.

The transport belt 14 begins running again (435 steps in the preferred embodiment) until the printer apparatus 10 achieves the programmed encoder count. This count is detected by belt position encoder sensors 153 (two sensors are used to perform this function). The belt drive motor 163 is enabled during the printing operation to assist in stabilizing the position of the card 110 on the belt 14. The card 110 or print head carriage 52 may be positioned by a sensor, for instance the print head carriage home sensor 155.

A first color (yellow) is moved into a predetermined position, the proper position detected by the ribbon index mark detector 158. The printer apparatus 10 will monitor the ribbon index bar and count the number of steps between each bar which will be used to check for slipping or possible breaks in the ribbon 76. This may be detected by the ribbon motion sensor 159.

The pressure roller drive motor 92 is activated to load the print head 50 against the card 110 and pressure roller 94, 140 steps in the preferred embodiment. The tension spring 98 is providing the pressure roller force. The pressure roller drive motor 92 will be enabled only during printing and released during ribbon advancement operations.

The print head carriage motor 56 activates to move the carriage 54 through the number of steps as determined by the image size for the yellow color, and then the carriage 54 is moved an additional number of steps (720 in this embodiment) to fully separate the ribbon 76 from the card surface 111. The print head carriage limit photo cell 156 prevents the carriage 54 from overshooting the necessary movement to separate the ribbon 76 from the card 110. The pressure roller motor 92 is reversed to release the load from the card 110. The pressure roller home photo cell 157 detecte proper retraction of the pressure roller 94.

The ribbon 76 is moved to the next color (magenta), and the printer carriage 54 is homed, this position being detected by the print head carriage home sensor 155. The printing operation now follows the same steps as above, and repeate through the last color (cyan). The print head carriage 54 is returned to the home position. The belt motor 163 is run again, and the card 110 is separated from the surface of the transport belt 14 due to the differential stretching of the soft urethane outside layer 120 of the belt 14. The card 110 is taken up by the outfeed guide roller assembly 28 to wait for the command to transfer the card 110 into either the next module, or to be manually picked. The position of the card 110 at outfeed is determined by the "CARD OUT" photo cell 152.

Cleaning of the transport belt 14 is activated by the system controller 162. The controller 162 will activate the cleaning tape drive motor 41 and the tape solenoid 47 to position the idler roller 48 against the transport belt 14. Any breaks in the cleaning tape 36 are detected by a cleaning tape motion detector photo cell 160.

The motors used in the preferred embodiment are stepper motors with 200 step per turn ability, and are bidirectional. The function and current ratings of each of the motors are a follows:

Print head carriage motor: 3.9 amps
12:1 geared lead screw to move the print head at a rate of 10 steps per dot row.

Cleaning tape takeup motor: 3.9 amps
Rotates cleaning tape takeup spindle and, indirectly, the two cleaning ribbon drive rollers.

Pressure roller position motor: 1.0 amp
Lowers the pressure roller against the print head.

Transport belt drive motor: 1.0 amp
Drives the infeed and outfeed guide rollers plus any required internal transport roller sets. Also drives the transport belt. All roller sets will be clutched to allow no movement in the opposite direction of normal transport when the belt is being cleaned.

Ribbon takeup motor: 1.0 amp
Advances color ribbon to next panel or next set of color panels.

Cleaning roller position motor: 1.0 amp
Positions the card cleaning roller into its operational or cleaning position.

Print Head Controller Apparatus

A print head control interface to connect a microprocessor to a continuous tone print head is shown in FIG. 4. A first microprocessor 301 sends 8-bit image data to a first-in first-out (FIFO) memory 319 and a second identical FIFO memory 321 via a common first data bus 305. Two FIFO memories are used to implement double buffering so that data may be written to one FIFO memory while simultaneously being read from the other FIFO memory.

It will be recognized that it is possible to modify the interface and eliminate the FIFO memory 321 and multiplexer 307 and use only FIFO memory 319 if double buffering is not required. It will also be recognized that the interface may be modified such that data words of any commonly used length other than 8 bits may be written to and read from interface elements After the microprocessor 301 has sent the image data to FIFO memories 319 and 321, it is freed from further print head control tasks and may execute other tasks until it is time to print the next row in the image. A state machine 325 implemented as a programmable gate array uses a control line 317 to signal a multiplexer 307 to select between FIFO memories 319 and 321 via control lines 313 and 315. Control lines 323 and 327 are used by the state machine 325 to initiate the transfer of image data from FIFO memories 319 and 321 to a comparitor 333 via a second data bus 327. A third data bus 331 is used to transfer level values generated from the state machine 325 to the comparitor. The comparitor 333 compares an image data pixel value with a level value generated by the state machine 325 and outputs a one-bit value via lines 343 and 345 to a print head 341, the comparison process repeating for a number of iterations equal to the number of print intensities being used. In multi-color printing, a one's complement subtraction is performed by the comparitor 333 to convert a red, green and blue (RGB) additive color intensity value to a cyan, yellow, and magenta (CYM) subtractive color intensity.

In the preferred embodiment the image height is 512 pixels and the print head is preferably implemented with two 256×1 bit print head elements in order to provide faster data transfer.

It will be recognized that any reasonable image height or width in pixels other than a value of 512 may be used with the present invention without loss of generality to allow for an increase or decrease in the size of the printing area, or to allow for an increase or decrease in the resolution of the image. It will also be recognized that and number of print head elements may be used in place of a single print head element as long as their collective height adds up to the total image height. For instance, for an image height of 512 pixels, a single 512×1 bit print element, two 256×1 bit print elements, four 128×1 bit print elements, and so on, may be used to implement a 512 pixel print head.

The state machine 325 is preferably implemented with a programmable gate array and is connected to the print head 341 via a clock line 339, a strobe line 337, and a latch line 335. In order to allow for different configurations, the number of print intensities as well as the programming for the state machine 325 are sent from a second microprocessor 303 via a forth data bus 309 to the state matching 325. Control information is sent to the second microprocessor 303 from the state machine 325 via a control line 311, and then to the first microprocessor 301 via a control line 347.

It will be recognized that other embodiments for the state machine are possible, including but not limited to using a fixed gate array or a microprocessor. It will also be recognized that it is possible to eliminate the second microprocessor 303 and use only the first microprocessor 301 in order to reduce the cost of the interface. It will further be recognized than when more than one print element is used to implement print head 341, there will be a corresponding comparitor 333 and control lines 335, 337, and 339 for each print element in the print head.

Figure 15:
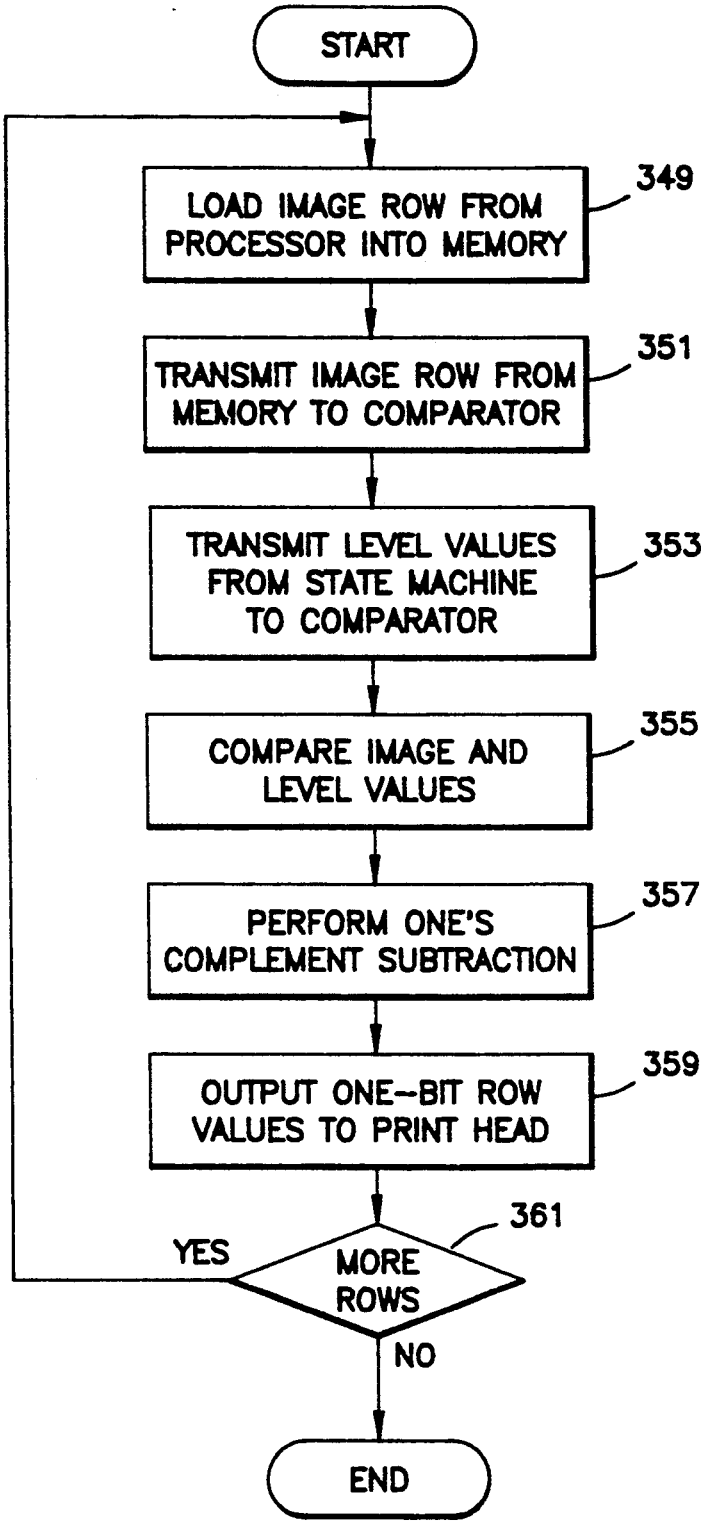
FIG. 15 is a flow diagram of a print process used with the present invention.

A method for printing a digital continuous tone image is illustrated in FIG. 15. At 349, image row values from the microprocessor are loaded into memory. At 351, upon a signal from the state machine, the image row values are transmitted from the memory to the comparitor. Level values are then transmitted from the state machine to the comparitor at 353, and the image row values and level values are compared at 355. If this is a color printing process a one's complement subtraction is performed on the RGB image values to convert them to CYM values. The appropriate one-bit row values are then output to the print head at 359. If at 361 there are more rows in the image remaining to be printed, control returns to 349.

Analysis

In a typical application where 64 print intensities are used, a load cycle of a 512 pixel print head will take $512 \times t_{clock}$ amount of time. If $t_{clock}$ is 250 nanoseconds (ns), then a single cycle will be 64 microseconds (μs) long. A tonal line will be printed in 64×64 μs or 4.096 milliseconds (ms). During this time, the controller is active, but the microprocessor, assuming a 1 μs memory cycle, is only active for 512 μs servicing the print head. This frees the microprocessor for approximately 3.5 ms of every 4 ms or about 87.5% of the time during printing. In practice, this results in approximately a 3 to 1 improvement in observed print speed.

It is to be understood that even though numerous characteristics and advantages of the present invention have been set forth in the foregoing descriptions, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An apparatus for manipulating movement of a workpiece, such as a plastic card, relative to a printer apparatus including a print head for printing the card, comprising:

a transport belt, the transport belt including a card surface means for self-adhering the card on the transport belt without requiring any additional retaining structure, said card surface means including an outer layer of the transport belt having different elasticity from an inner layer of the transport belt; and carriage means for supporting the print head adjacent the transport belt whereby the card is disposed between the print head and the belt while printing on the card.

2. An apparatus according to claim 1, the print head carriage means including means for moving the print head relative to the card while printing on the card.

3. An apparatus according to claim 1, further comprising multiple print heads.

4. An apparatus according to claim 1, further comprising card cleaning roller means for cleaning the surface of the card, to be printed and pressing the card onto the transport belt.

5. An apparatus according to claim 1, further comprising a pressure roller, the pressure roller being positioned opposite the print head such that a portion of the transport belt passes between the print head and the pressure roller.

6. An apparatus according to claim 1, further comprising card transport carriage means for moving the card transport belt relative to the print head while printing on the card.

7. An apparatus according to claim 1, wherein the transport belt is an endless loop.

8. An apparatus according to claim 1, wherein the transport belt is retained in horizontal alignment with the print head by two sets of horizontal ribs on the inner surface of the transport belt which conform to corresponding grooves in pulleys which drive the transport belt.

9. An apparatus according to claim 1, wherein the transport belt is composed of a soft elastomer material.

10. An apparatus according to claim 9, wherein the transport belt is composed of urethane.

11. An apparatus according to claim 1, wherein the outer layer of the transport belt is composed of 10 to 20 durometer shore A urethane elastomer with a 5 percent plasticizer.

12. An apparatus according to claim 11, wherein the inner layer of the transport belt is composed of 70 to 90 durometer shore A urethane elastomer reinforced with a fiber layer.

13. An apparatus according to claim 1, further comprising ribbon supply means for supplying a thermal transfer multi-color printing ribbon between the print head and the card.

14. An apparatus according to claim 13, wherein the thermal transfer color printing ribbon includes tonal CYMB-subtractive color dyes.

15. An apparatus according to claim 13, wherein the therma transfer color printing ribbon includes color pigments.

16. An apparatus according to claim 2, wherein the print head carriage means comprises:

bearing shaft means for supporting and guiding the carriage block;

carriage supports at either end of the bearing shaft means;

means for driving a carriage in a linear motion along the bearing shaft means.

17. An apparatus according to claim 16, wherein the print carriage driving means includes a lead screw assembly, the lead screw assembly including a lead screw shaft interconnected at an output end to an input end of a drive shaft by constant velocity coupling means for moving the print head at a constant rate.

18. An apparatus according to claim 17, wherein the constant velocity coupling means includes a coupling shaft with a hex bore, the hex bore loosely accommodating spherical hex ends on the output end of the drive shaft and on the input end of the lead screw shaft.

19. An apparatus according to claim 1, further including pivotal support means for pivotally supporting the carriage whereby the carriage can be pivoted away from the card path.

20. An apparatus according to claim 1, further comprising a print head controller means for interfacing between at last one microprocessor and at least one continuous tone print head, the number of print intensities either fixed or selected by the microprocessor, the print head controller means comprising:

(a) memory means for storing digital image data to be sent to the print head, the memory means connected to the microprocessor via a first data bus;

(b) comparator means for comparing two multi-bit digital inputs and outputting a one-bit value to the print head if a pixel is to e printed, the comparator means connected to the memory means via a second data bus; and (c) state machine means for reading the digital image data from the memory means and comparing a pixel value to a level value generated by the state machine means for a number of iterations equal to the number of print intensities, the state machine means connected to the comparator means via a third data bus.

21. An apparatus according to claim 20, wherein the memory means comprises at least two identical FIFO memories.

22. An apparatus according of claim 21, wherein the apparatus further comprises multiplexer means for selecting between the FIFO memories, the multiplexer means connected to an controlled by the state machine means.

23. An apparatus according to claim 20, wherein the state machine means comprises a programmable gate array means connected to the microprocessor via a fourth data bus.

24. A method of conveying a workpiece such as a plastic card through a printer apparatus, including a print head, comprising the steps of:

feeding a card along a card pathway into the printer apparatus;

depositing and self-adhering the cad on a transport belt for transport through the printer apparatus without requiring any additional retaining structure, said transport belt including an outer layer of the transport belt having différent elasticity from an inner layer of the transport belt;

conveying the card into a printing position;

conveying the card away from the printing position;

releasing the card form the transport belt by differentially stretching the outer and inner layers of the transport belt; and transporting the card away from the printer apparatus.

25. A method in accordance with claim 24, wherein the step of retaining the card on the transport belt includes self adhering the card to a surface of the belt.

26. A method in accordance with claim 24, further including the step of cleaning the surface of the card by engaging the surface of the card with a cleaning ribbon.

27. A method in accordance with claim 24, further including the step of cleaning a surface of the transport belt.

28. A method in accordance with claim 24, further including the step of printing on the card including moving a print head of the printer apparatus along the surface of the card while maintaining the card in a stationary position.

29. A method in accordance with claim 24, including the step of moving the transport belt in an endless loop.

30. A method according to claim 24, further comprises a step of controlling at least one continuous tone print head by printing a digital continuous tone image values with at least one microprocessor, at least one digital memory, a comparator and a state machine, the site of controlling comprising the step of:

(a) loading the image value form the microprocessor into the memory;

(b) transmitting the image values from the memory to the comparator;

(c) transmitting level values generated by the state machine to the comparator;

(d) comparing the image values with the level values;

(e) performing a one's complement subtraction to convert RGB values to CYM values, if required;

(f) outputting the appropriate one-bit values to the print head; and (g) returning control to step (a) if there are more rows in the image remaining to be printed.

31. A print head controller apparatus for interacting between at least one microprocessor and at least one continuous tone print head, the number of print intensities either fixed or selected by the microprocessor, the apparatus comprising:

(a) memory means for storing digital image data to be sent to the print head, the memory means connected to the microprocessor via a first data bus;

(b) comparator means for comparing tow multi-bit digital inputs and outputting a one-bit value to the print head if a pixel is to be printed, the comparator means connected to the memory means via a second data bus; and (c) state machine means for reading the digital image data from the memory means and comparing a pixel value to a level value generated by the state machine means for a number of iterations equal to the number of print intensities, the state machine means connected to the comparator means via a third data bus.

32. The print head controller apparatus of claim 31 wherein the memory means comprises at least two identical FIFO memories.

33. The print head controller apparatus of claim 32 wherein the apparatus further comprises multiplexer means for selecting between the FIFO memories, the multiplexer means connected to and controlled by the state machine means.

34. The print head controller apparatus of claim 31 wherein the state machine means comprises a programmable gate array means connected to the microprocessor via a fourth data bus.

35. A method of printing a digital continuous tone image values with at least one microprocessor, at least one digital memory, a comparator, a state machine, and at least one continuous tone print head, the method comprising the steps of:

(a) loading the image values from the microprocessor into the memory;

(b) transmitting the image values from the memory to the comparator;

(c) transmitting level values generated by the state machine to the comparator;

(d) comparing the image values with the level values;

(e) performing a one's complement subtraction to convert RGB values to CYM values, if required;

(f) outputting the appropriate one-bit values to the print head; and (g) returning control to step (a) if there are more rows in the image remaining to be printed.

36. An apparatus for manipulating movement of a workpiece, such as a plastic card, relative to a printer apparatus including a print head, comprising:

a transport belt, the transport belt including a card retention surface means for retaining the card on the transport belt;

carriage means for supporting the print head; and card cleaning roller means for cleaning the surface of the card to be printed and pressing the cad onto the transport belt.

37. An apparatus for manipulating movement of a workpiece, such as a plastic card, relative to a printer apparatus including a print head, comprising:

a transport belt, the transport belt including a card retention surface means for retaining the card on the transport belt;

carriage means for supporting the print head; an wherein the transport belt is composed of an inner layer and an outer layer, the outer layer being composed of 10 to 20 durometer elastomer.

38. An apparatus for manipulating movement of a workpiece, such as a plastic card, relative to a printer apparatus including a print head, comprising:

a transport belt, the transport belt including a card retention surface means for retaining the card on the transport belt;

carriage means for supporting the print head, the print head carriage means including means for moving the print head relative to the card while printing on the card;

wherein the print head carriage means comprises:

a carriage block onto which is mounted a thermal print head;

bearing shaft means for supporting and guiding the carriage block;

carriage supports at either end of the bearing shaft means;

means for driving the carriage in a linear motion along the bearing shaft means, the print head carriage driving means including a lead screw assembly, the lead screw assembly including a lead screw shaft interconnected at an output end to an input end of a drive shaft by constant velocity coupling means for moving the print head at a constant date; and wherein the constant velocity coupling means includes a coupling shaft with a hex bore, the hex bore loosely accommodating spherical hex ends on the output end of the drive shaft and on the input end of the lead screw shaft.

39. An apparatus for manipulating movement of a workpiece, such as a plastic card, relative to a printer apparatus including a print head, comprising:

a transport belt, the transport belt including a card retention surface mans for retaining the card on the transport belt;

carriage means for supporting the print head; and a print head controller means for interfacing between at least one microprocessor and at least one continuous tone print head, the number of print intensities either fixed or selected by the microprocessor, the print head controller means comprising:

Z(a) memory means for storing digital image data to be sent to the print head, the memory means connected to the microprocessor via a first data bus;

(b) comparator means for comparing two multi-bit digital inputs and outputting a one-bit value to the print head if a pixel is to be printed, the comparator means connected to the memory mans via a second data bus; and (c) state machine means for reading the digital image data from the memory means and comparing a pixel value to a level value generated by the state machine means or a number of iterations equal to the number of print intensities, the state machine means connected to the comparator means via a third data bus.

* * * * *

UNITED STATES PATENT AND TRADEMARK OFFICE
CERTIFICATE OF CORRECTION

PATENT NO. : 5,239,926

DATED : 08/31/93

INVENTOR(S) : Richard C. Nubson, et al.

It is certified that error appears in the above-identified patent and that said Letters Patent is hereby corrected as shown below:

In Column 4, lines 13 to 22, delete the phrase

"FIG. 3 is a top diagrammatical view of alternate embodiment of the present invention showing a transport belt which is taken up by pulleys at both ends of the belt;

FIG. 4 is a block diagram of an alternative embodiment of the present invention showing multiple print heads;

FIG. 5 is a side elevational view in cross-section of the transport belt and pulley taken along the line 5-5 in FIG. 2a;".

and insert therefor

-- FIG. 3 is a side elevational view in cross-section of the transport belt and pulley taken along the line 3-3 in FIG. 2a;

FIG. 4 is a top diagrammatical view of an alternate embodiment of the present invention showing a transport belt which is taken up by pulleys at both ends of the belt;

FIG. 5 is a block diagram of an alternative embodiment of the present invention showing multiple print heads;--.

In Column 17, line 7, Claim 15, "therma" should read --thermal--.
In Column 17, line 18, Claim 17, insert --head-- after the word "print".
In Column 18, line 3, Claim 24, "cad" should read --card--.
In Column 18, line 51, Claim 31, "interacting" should read --interfacing--.
In Column 18, line 59, Claim 31, "tow" should read --two--.
In Column 17, line 60, Claim 22, "an" should read --and--.
In Column 18, line 37, Claim 30, "step" should read --steps--.
In Column 18, line 38, Claim 30, "value form" should read --values from--.
In Column 19, line 42, Claim 36, "cad" should read --card--.
In Column 19, line 50, Claim 37, "an" should read --and--.
In Column 20, line 22, Claim 38, "date" should read --rate--.
In Column 20, line 32, Claim 39, "mans" should read --means--.
In Column 20, line 40, Claim 39, delete "Z" before "(a)".
In Column 20, line 47, Claim 39, "mans" should read --means--.
In Column 20, line 52, Claim 39, "or" should read --for--.

UNITED STATES PATENT AND TRADEMARK OFFICE

CERTIFICATE OF CORRECTION

PATENT NO. : 5,239,926
DATED : August 31, 1993
INVENTOR(S) : Richard C. Nubson, et. al.

It is certified that error appears in the above-indentified patent and that said Letters Patent is hereby corrected as shown below:

In Column 17, line 11, Claim 16, insert --a carriage block onto which is mounted a thermal print head; after the word "comprises".

Signed and Sealed this

Thirtieth Day of May, 1995

*Attest:*

Bruce Lehman

BRUCE LEHMAN

*Attesting Officer*

*Commissioner of Patents and Trademarks*